US012428191B2

(12) United States Patent
Anderson

(10) Patent No.: US 12,428,191 B2
(45) Date of Patent: Sep. 30, 2025

(54) CADDY WITH REMOVABLE SPILL PREVENTION STABILIZERS AND BUMPERS

(71) Applicant: James L. Anderson, West Fargo, ND (US)

(72) Inventor: James L. Anderson, West Fargo, ND (US)

( * ) Notice: Subject to any disclaimer, the term of this patent is extended or adjusted under 35 U.S.C. 154(b) by 162 days.

(21) Appl. No.: 18/195,670

(22) Filed: May 10, 2023

(65) Prior Publication Data

US 2023/0278746 A1 Sep. 7, 2023

Related U.S. Application Data

(63) Continuation-in-part of application No. 17/408,842, filed on Aug. 23, 2021, now Pat. No. 11,753,200.

(51) Int. Cl.
*B65D 1/36* (2006.01)
*B65D 25/28* (2006.01)

(52) U.S. Cl.
CPC ..... *B65D 1/36* (2013.01); *B65D 25/2826* (2013.01)

(58) Field of Classification Search
CPC .. B65D 25/107; B65D 25/103; B65D 25/102; B65D 25/101; B65D 25/10; B65D 25/24; B65D 25/2802; B65D 25/2826; B65D 81/107; B65D 81/05; B65D 81/02; B65D 81/3818; B65D 81/383; B65D 81/027; B65D 11/16; B65D 2571/00086; B65D 2501/24605; B65D 21/066; B65D 21/0215; B65D 21/0224; B65D 1/34; B65D 1/243; B65D 1/24; B65D 1/36; B65D 90/028
USPC ..... 206/516, 565, 545; 220/592.27
See application file for complete search history.

(56) References Cited

U.S. PATENT DOCUMENTS

| | | | |
|---|---|---|---|
| 435,023 | A | 8/1890 | Robinson |
| D148,457 | S | 1/1948 | Civita |
| 2,771,232 | A | 11/1956 | Reed |
| D196,665 | S | 10/1963 | Barnett |

(Continued)

FOREIGN PATENT DOCUMENTS

| | | |
|---|---|---|
| KR | 301137476.0000 | 11/2021 |
| WO | WOD214402-015 | 2/2021 |

OTHER PUBLICATIONS

Spill Spoiler—The Ultimate Detailing Caddy—Won't Scratch or Slip—Made in the USA—Amazon, Date of Oldest Photo Review Jul. 24, 2023, amazon.com, [online], [site visited Nov. 13, 2023], Available from internet URL <https://www.amazon.com/dp/B0C9S4G5M7?ref_=cm_sw_r_cp_ud_dp_GS9GSX695HNKZZ76KGYTC> (year: 2023).

*Primary Examiner* — Robert Poon
(74) *Attorney, Agent, or Firm* — Kinney & Lange, P.A.

(57) ABSTRACT

A caddy system includes a caddy and stabilizers. The caddy includes an outer shell, an inner compartment, and a handle. The outer shell has walls that define corners. A bottom edge of the outer shell includes bottom surfaces of the walls. The caddy also includes a top rim. The inner compartment is surrounded by the outer shell and connects to the outer shell at the top rim. The inner compartment has a plurality of pockets. Each pocket has an open top and a closed bottom. The handle is connected to the inner compartment. The stabilizers connect to the caddy at the corners. An area defined by outer ends of the connected stabilizers is larger than an area defined by the bottom edge of the caddy.

6 Claims, 30 Drawing Sheets

(56) References Cited

U.S. PATENT DOCUMENTS

| | | | | |
|---|---|---|---|---|
| 3,603,474 | A | 9/1971 | Erickson | |
| 3,782,582 | A | 1/1974 | Lybbert et al. | |
| 4,111,305 | A | 9/1978 | Thomas | |
| 4,181,226 | A * | 1/1980 | Weinert | B65D 25/32 220/773 |
| 4,204,596 | A | 5/1980 | Davis | |
| D257,914 | S | 1/1981 | Wooters | |
| D307,355 | S | 4/1990 | Page | |
| D327,364 | S | 6/1992 | Mankey | |
| D327,562 | S | 6/1992 | Brightbill | |
| D329,135 | S | 9/1992 | Embree | |
| 5,267,389 | A * | 12/1993 | Chumley | B65D 25/28 29/527.1 |
| D357,119 | S | 4/1995 | Vura et al. | |
| D362,837 | S | 10/1995 | Mankey et al. | |
| 5,456,357 | A | 10/1995 | Wenner et al. | |
| D364,039 | S | 11/1995 | Kruger | |
| D368,889 | S | 4/1996 | Mankey et al. | |
| 5,509,633 | A | 4/1996 | Ruster et al. | |
| 5,975,342 | A | 11/1999 | Bradeen et al. | |
| 6,076,876 | A | 6/2000 | Letourneau et al. | |
| 6,089,638 | A | 7/2000 | Whitnell | |
| 6,221,317 | B1 * | 4/2001 | Carl | B01L 9/543 211/60.1 |
| D492,113 | S | 6/2004 | Bayer et al. | |
| 6,880,191 | B2 | 4/2005 | Bristor | |
| D511,894 | S | 11/2005 | Janney et al. | |
| D519,913 | S | 5/2006 | Emerson | |
| D522,751 | S | 6/2006 | Irwin et al. | |
| D546,063 | S | 7/2007 | Snyder | |
| D608,015 | S | 1/2010 | Sandel | |
| D608,456 | S | 1/2010 | Sandel | |
| D653,603 | S | 2/2012 | Stroud et al. | |
| D690,939 | S | 10/2013 | Lintz et al. | |
| D789,690 | S | 6/2017 | Foley | |
| D795,584 | S | 8/2017 | Walker et al. | |
| 9,744,909 | B2 | 8/2017 | Proulx et al. | |
| 10,252,858 | B1 | 4/2019 | Pearson et al. | |
| D876,835 | S | 3/2020 | Libman et al. | |
| D894,018 | S | 8/2020 | Dominion et al. | |
| D895,292 | S | 9/2020 | Barness | |
| D955,739 | S | 6/2022 | Mrtue et al. | |
| D962,080 | S | 8/2022 | Bonczyk et al. | |
| D987,180 | S | 5/2023 | Schwartz et al. | |
| 11,753,200 | B2 | 9/2023 | Anderson | |
| 2009/0194437 | A1 | 8/2009 | D'Agostino | |
| 2009/0314671 | A1 | 12/2009 | Anderson et al. | |
| 2010/0044265 | A1 | 2/2010 | Ragsdale et al. | |
| 2010/0276435 | A1 | 11/2010 | Fredette | |
| 2012/0074156 | A1 | 3/2012 | Roesser | |
| 2015/0144525 | A1 | 5/2015 | Luke | |
| 2016/0001292 | A1 | 1/2016 | Motadel et al. | |
| 2017/0369225 | A1 * | 12/2017 | Eberbach | B65B 61/22 |
| 2018/0235433 | A1 | 8/2018 | Dolan | |
| 2018/0242553 | A1 | 8/2018 | Németh | |
| 2020/0018425 | A1 | 1/2020 | Phillips et al. | |
| 2021/0147113 | A1 | 5/2021 | Workman | |
| 2021/0220221 | A1 * | 7/2021 | Komann | B65D 25/10 |
| 2021/0253302 | A1 * | 8/2021 | Guindi | B65D 21/0215 |
| 2023/0058440 | A1 | 2/2023 | Anderson | |
| 2023/0166904 | A1 * | 6/2023 | Kaur | B65F 1/141 206/511 |
| 2023/0278746 | A1 | 9/2023 | Anderson | |
| 2023/0365289 | A1 | 11/2023 | Anderson | |

* cited by examiner

CADDY WITH REMOVABLE SPILL PREVENTION STABILIZERS AND BUMPERS

CROSS-REFERENCE TO RELATED APPLICATION(S)

This application is a continuation-in-part of U.S. application Ser. No. 17/408,842, filed on Aug. 23, 2021, entitled "CADDY WITH SPILL PREVENTION STABILIZERS,"

BACKGROUND

Individuals who feature automobiles in car shows often drive their show cars to the venue, resulting in normal dirt, etc. In preparation for competition, they then perform last minute cleaning and touch ups. It is common for individuals to bring a touch up detailing kit with them to these events. These kits, bottles, and other items, can tip over during normal driving, causing as many problems as they solve. Similar issues can occur any time a caddy is transported by vehicle, rolling cart, or other means of transportation.

A caddy has multiple uses and should have a flexible design for different situations. For example, a caddy may need to be placed in different areas with different space constraints. Such areas include a roomy trunk for transportation and a cramped shelf for storage. In another example, a caddy may need to secure very small or unwieldy objects.

SUMMARY

A caddy system includes a caddy and stabilizers. The caddy includes an outer shell, an inner compartment, and a handle. The outer shell has walls that define corners. A bottom edge of the outer shell includes bottom surfaces of the walls. The caddy also includes a top rim. The inner compartment is surrounded by the outer shell and connects to the outer shell at the top rim. The inner compartment has a plurality of pockets. Each pocket has an open top and a closed bottom. The handle is connected to the inner compartment. The stabilizers connect to the caddy at the corners. An area defined by outer ends of the connected stabilizers is larger than an area defined by the bottom edge of the caddy.

A caddy system includes a caddy, stabilizers, and bumpers. The caddy includes an outer shell, an inner compartment, and a handle. The outer shell has walls that define corners. A bottom edge of the outer shell includes bottom surfaces of the walls. The caddy also includes a top rim. The inner compartment is surrounded by the outer shell and connects to the outer shell at the top rim. The inner compartment has a plurality of pockets. Each pocket has an open top and a closed bottom. The inner compartment also includes a plurality of bumper mounting slots positioned through the sides of the plurality of pockets. The handle is connected to the inner compartment. The stabilizers connect to the caddy at the corners. The bumpers connect to the caddy at each of the plurality of bumper mounting slots. An area defined by outer ends of the connected stabilizers is larger than an area defined by the bottom edge of the caddy.

DETAILED DESCRIPTION

Caddies are used in many situations to easily transport and organize supplies, in particular bottles of liquids and gels. When in transport, however, they are prone to tipping over, due to a high center of gravity from the tall bottles that are typically present. Tipping often results in spills and disorganization. The caddy described herein provides storage and organization while preventing tipping. The caddy includes stabilizers to provide support to stabilize the caddy and prevent it from tipping over, without significantly increasing the overall footprint or weight of the caddy.

Figure 1:
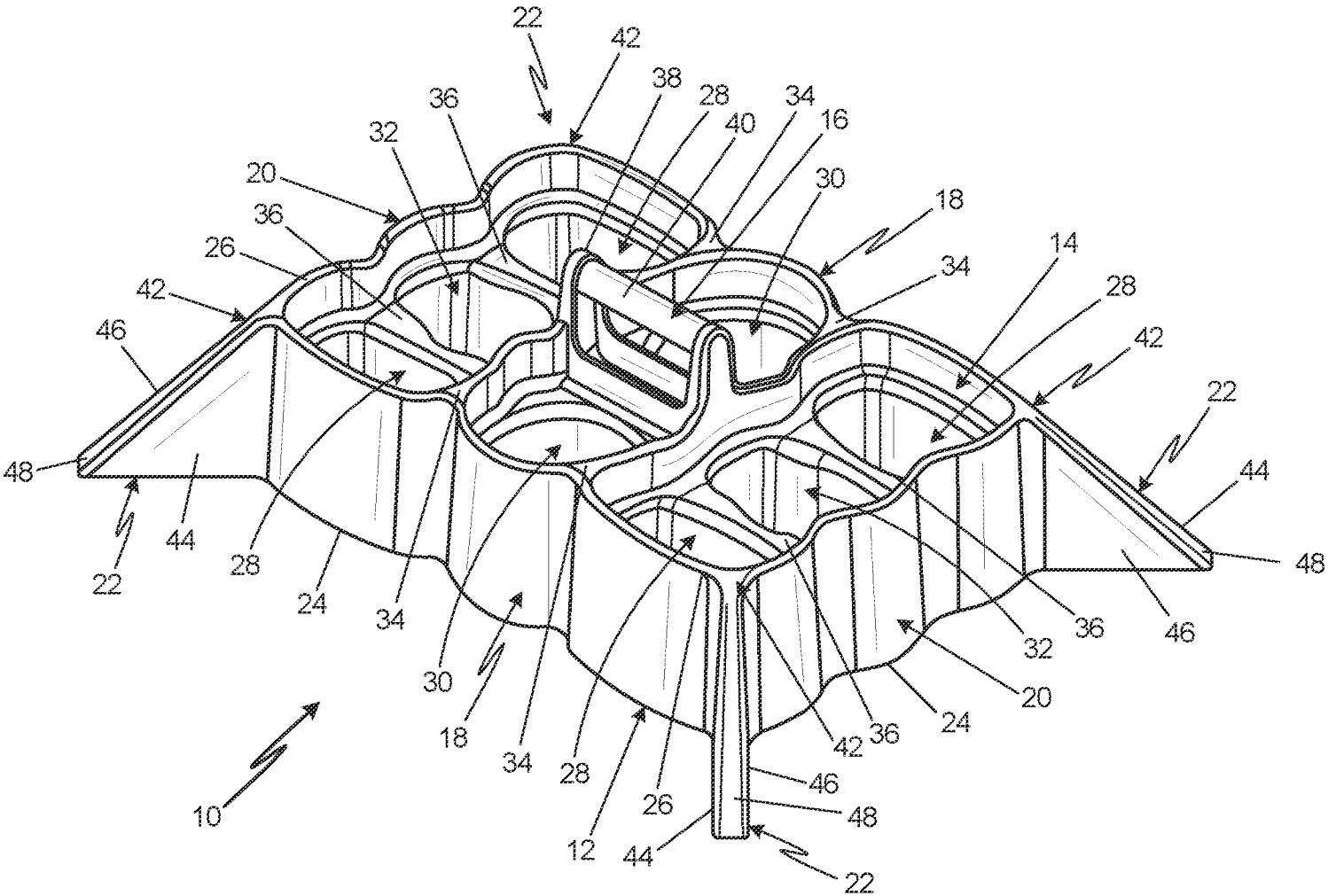
FIG. 1 is an isometric view showing an upper side of a caddy having eight pockets.

FIGS. 1-6 show caddy 10, which has eight pockets (or cups) that can filled with bottles, towels, tools, and other objects for a variety of different manufacturers. FIG. 1 is an isometric view showing an upper side of caddy 10, which includes outer shell 12, inner compartment 14, and handle 16. Outer shell 12 includes side walls 18, end walls 20, stabilizers 22, bottom edge 24, and top rim 26. Inner compartment 14 includes corner pockets 28, side pockets 30, end pockets 32, upper dividers 34, and lower dividers 36. Handle 16 includes handle mounts 38 and crossbar 40. Handle 16 is oriented parallel to side walls 18 and perpendicular to end walls 20.

Caddy 10 has four corners 42. Each stabilizer 22 is located at a different one of the corners 42. Stabilizers 22 extend outward and downward from corners 42. Each stabilizer 22 includes stabilizer side wall 44, stabilizer end wall 46, and stabilizer top cap 48. Each stabilizer side wall 44 is connected to an adjacent side wall 18, and each stabilizer end wall 46 is connected to an adjacent end wall 20. Each stabilizer top cap connects adjacent stabilizer side and end walls 44 and 46 so that they are spaced from one another.

Figure 2:
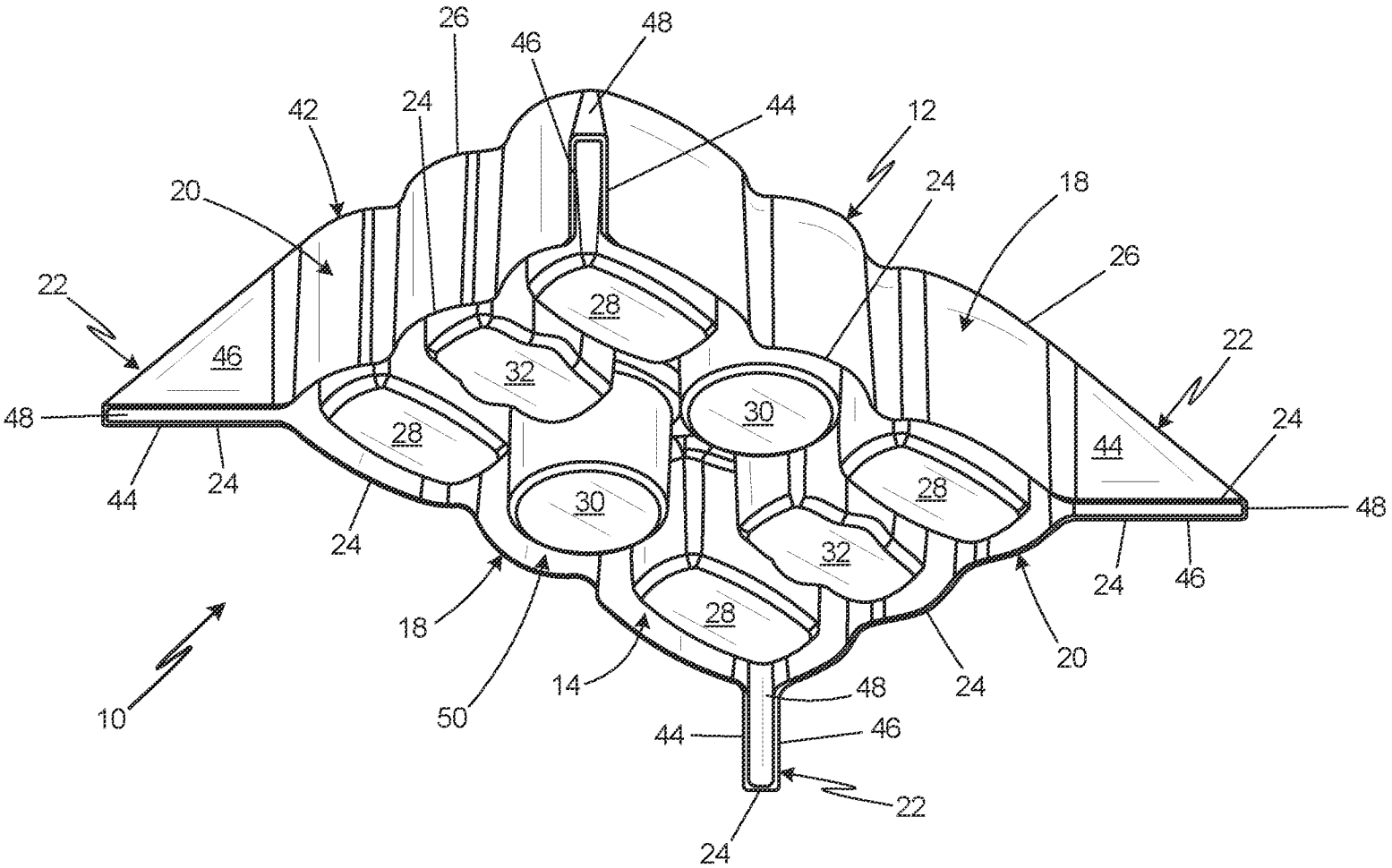
FIG. 2 is an isometric view showing an under side of the caddy of FIG. 1.

FIG. 2 shows caddy 10 from below, so that the under sides of out shell 12 and inner compartment 14 can be seen. Shown in FIG. 2 are caddy 10, outer shell 12, inner compartment 14, handle 16 (shown in FIG. 1), side walls 18, end walls 20, stabilizers 22, bottom edge 24, top rim 26, corner pockets 28, side pockets 30, end pockets 32, upper divider 34 (shown in FIG. 1), lower dividers 36 (shown in FIG. 1), stabilizer side wall 44, stabilizer end wall 46, and stabilizer top cap 48. A double walled structure is formed by outer shell 12 and inner compartment 14 and shown in FIG. 2. The double walled construction creates hollow space 50, which surrounds corner pockets 28, side pockets 30, and end pockets 32, is contained by the inner surfaces of side walls 18 and end walls 20 of outer shell 12 and walls 44 and 46 and cap 48 of stabilizers 22. Hollow space 50 reduces the amount of material, and therefore the overall weight, of caddy 10. The double walled structure provides structural strength while reducing the amount of material needed to form caddy 10.

In one embodiment, caddy 10 is formed of a plastic material using a molding process, such as injection molding. In other embodiments, caddy 10 can be formed using other processes, such as rotomolding, 3D printing, compression molding, vacuum molding, and thermomolding. Caddy 10 can be made of any suitable plastic material, for example a thermoplastic, such as acrylonitrile butadiene styrene (ABS).

As shown in FIGS. 1 and 2, outer shell 12 (including side walls 18 and end walls 20 of outer shell 12 and walls 44 and 46 of stabilizers 22) flares outward from top rim 26 to bottom edge 24. This increases the area encompassed by bottom edge 24 compared to top rim 26 to provide stability to caddy 10. In addition, the flaring of outer shell 12, together with tapering of the outer surfaces of pockets 28, 30, and 32 assists in removal of caddy 10 from the mold used to form caddy 10.

Caddy 10 has a double walled structure. This provides structural strength while reducing the amount of plastic material needed to form caddy 10. Reduction in the amount of plastic required reduces cost of materials. It also reduces the total weight of caddy 10, which is an advantage for the user.

Pockets 28, 30, and 32 of inner compartment 14 can be any suitable shape or dimension, based on the particular items that will be carried in caddy 10. In some embodiments storage compartments are circles, rectangles, and/or rounded rectangles in order to conform to the shape of the items that are intended to be stored therein. Similarly, in some embodiments inner compartment 14 is configured to snugly fit the items that are intended to be stored therein, for example, car wax, cleaning wipes, spray bottles, rags, or sponges. Pockets 28, 30, and 32 can be the same shape or different shapes to accommodate, for example, different bottle types. In some embodiments, corner pockets 28 are rounded rectangles, side pockets 30 are circular, and end pockets 132 are rounded rectangles with slight protrusions.

Figure 3:
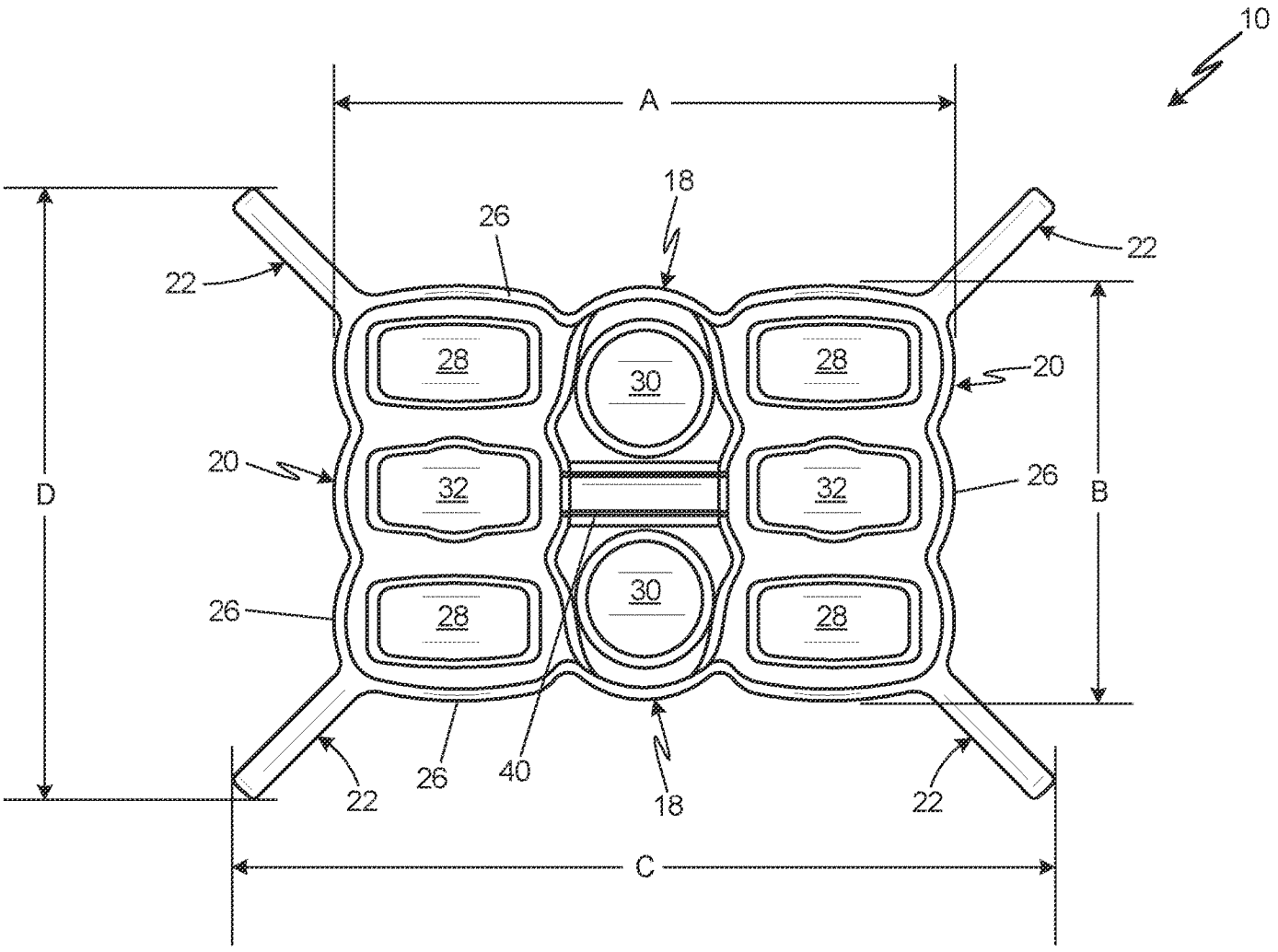
FIG. 3 is a top view of the caddy of FIG. 1.

FIG. 3 is a top view of caddy 10. Contouring of the inner walls and bottom of corner pockets 28, side pockets 30, and end pockets 32 can be seen in FIG. 3. FIG. 3 shows dimensions A-D. Dimension A is a length between the outer surfaces of end walls 20. Dimension B is a width between the outer surfaces of side walls 18. Dimension C is a length between outer ends of two stabilizers 22 separated by side wall 18. Dimension D is a width between outer ends of two stabilizers 22 separated by end wall 20.

Figure 4:
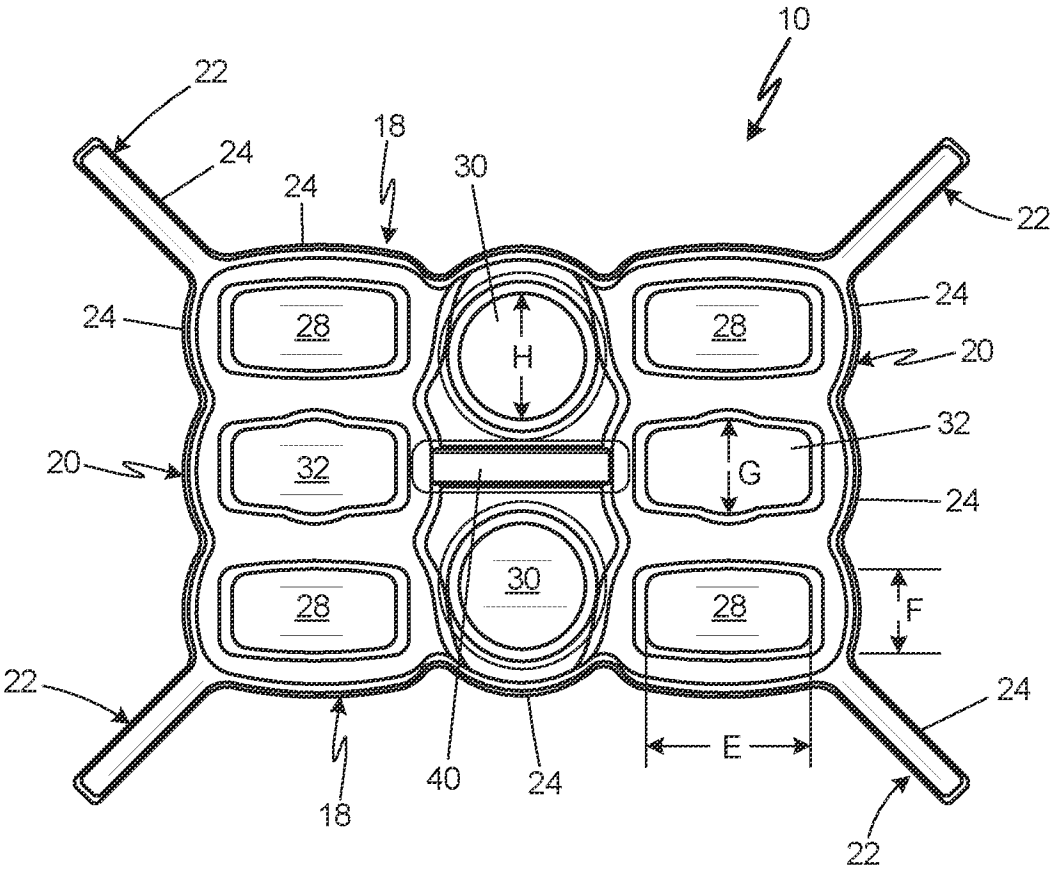
FIG. 4 is a bottom view of the caddy of FIG. 1.

FIG. 4 is a bottom view of caddy 10. Contouring of the outer walls and bottom of corner pockets 28, side pockets 30, and end pockets 32 can be seen in FIG. 4. Dimensions E-H are shown in FIG. 4. Dimension E is a bottom length of corner pockets 28, and dimension F is a bottom width of corner pockets 28. Dimension G is a bottom width of end pockets 32, which is the same as the dimension E. Dimension H is the bottom diameter of side pocket 30.

Figure 5:
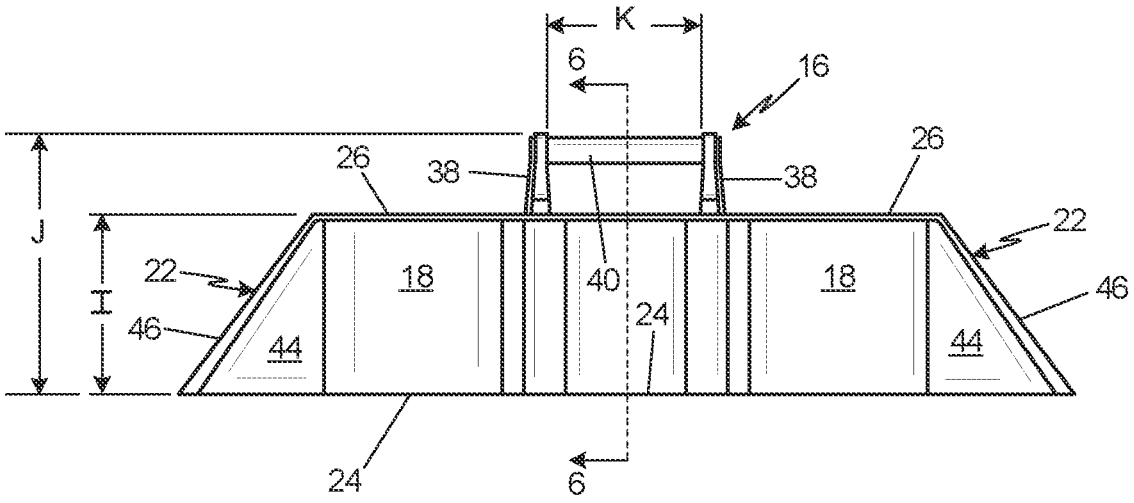
FIG. 5 is a side view of the caddy of FIG. 1.

FIG. 5 is a side view of caddy 10 showing side wall 18, stabilizers 22 at opposite ends of side wall 18, bottom edge 24, top rim 26, and handle mounts 38 and crossbar 40 of handle 16. FIG. 5 shows dimensions I-K. Dimension I is the height from bottom edge 24 to top rim 26. Dimension J is the height from bottom edge 24 to the top of handle 16. Dimension K is the length of crossbar 40 of handle 16.

Figure 6:
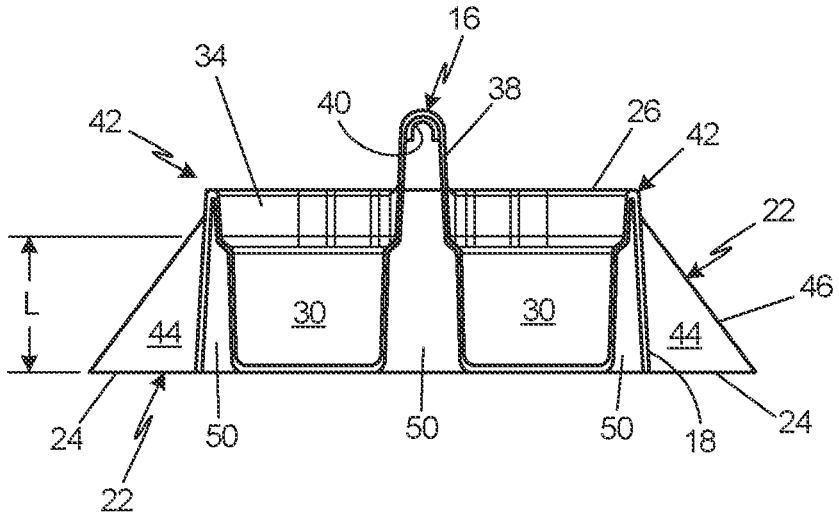
FIG. 6 is a sectional view of the caddy of FIG. 5 taken along line 6-6.

FIG. 6 is a sectional view of caddy 10 taken along section 6-6 of FIG. 5. FIG. 6 shows side walls 18, stabilizers 24, bottom edge 24, top rim 26, side pockets 30, upper divider 34, lower dividers 36, handlebar 38, crossbar 40, walls 44 and caps 46 of stabilizers 22, and hollow space 50. FIG. 6 shows dimension L, which it the height of lower dividers 36.

For example, in one embodiment, dimension A is 16⅞ inches; dimension B is 11⅜ inches; dimension C is 22⅜ inches, and dimension D is 16¾ inches. Dimension E is 4½ inches, and dimension F is 2⅜ inches; and dimension G is 4½ inches. Dimension H is 3½ inches.

Based upon dimensions A and B, the area defined by the four corners 42 of caddy 10 excluding stabilizers 22 is about 192 square inches. In contrast, based upon dimensions C and D, the area defined by the four outermost ends of stabilizers 22 (or an effective base area of caddy 10) is about 375 square inches. The area defined by the outer most corners of stabilizers 22 is 1.95 times larger than the same caddy without stabilizers 22. This larger support base created by stabilizers 22 provides enhanced stability for caddy 10.

Stabilizers 22 effectively lengthen and widen the base of the caddy 10, which prevents lateral forces (e.g. braking, accelerating, etc.) from causing caddy 10 to topple over. Stabilizers 22 are shown in FIGS. 1-6 as having a triangular shape, but stabilizers can take a variety of shapes so long as the outmost ends of the stabilizers both widen and lengthen the effective base area of caddy 10. Examples of other stabilizer structures include outriggers and buttresses. Although stabilizers 22 are shown as having a 45 degree angle with respect to top rim 26, the angle can be varied, for example between about 40 degrees and about 50 degrees. Increasing the angle will result in an increase in the distance stabilizers extend outward from the corners, and thus will increase the effective base area defined by stabilizers 22. Reducing the angle will have an opposite effect.

When in use, the empty or full caddy 10 is placed with bottom edge 24 on a relatively flat surface, for example, a trunk floor or a shelf of a rolling cart. Items to be transported are placed in the storage compartment or compartments in an upright position. The transportation method (car, dolly, cleaning cart, etc.) can then be moved. While in transport, the buttresses stabilize the caddy, preventing it and the items being transported from tipping over, despite the items making caddy 10 top heavy, and liquids causing major shifts in the center of gravity during transport. Because stabilizers 22 are narrow, other items can be packed around the caddy with few restrictions beyond the perimeter of caddy 10.

FIGS. 7-12 show caddy 110, which has six pockets that can filled with bottles, towels, tools, and other objects. Caddy 110 shown in FIGS. 7-12 has a similar overall structure and design to caddy 10 shown in FIGS. 1-7. However, caddy 110 has six pockets rather than eight pockets, and has a smaller size than caddy 10. The reference numerals that refer to parts of caddy 110 are incremented by one-hundred compared to the reference numerals that refer to parts of caddy 10 shown in FIGS. 1-7.

Figure 7:
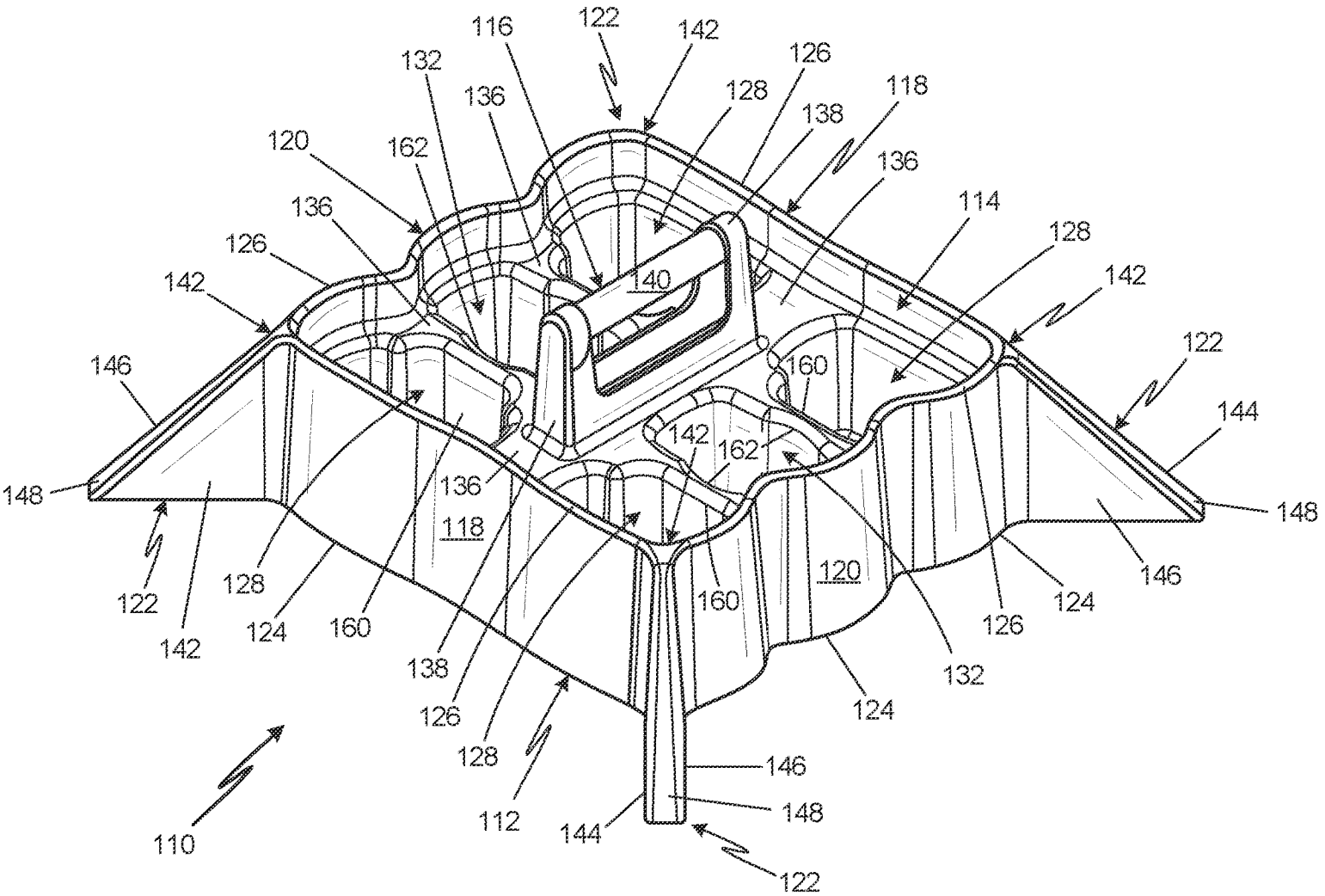
FIG. 7 is a is an isometric view showing an upper side of a caddy having six pockets.

FIG. 7 is an isometric view showing an upper side of caddy 110, which includes outer shell 112, inner compartment 114, and handle 116. Outer shell 112 includes side walls 118, end walls 120, stabilizers 122, bottom edge 124, and top rim 126. Inner compartment 114 includes four corner pockets or cups 128, two end pockets 132, and lower dividers 136. Handle 116 includes handle mounts 138 and crossbar 140. Handle 116 is oriented perpendicular to side walls 118 and parallel to end walls 120.

Caddy 110 has four corners 142. Each stabilizer 122 is located at a different one of the corners 142. Stabilizers 122 extend outward and downward from corners 142. Each stabilizer 122 includes stabilizer side wall 144, stabilizer end wall 146, and stabilizer top cap 148. Each stabilizer side wall 144 is connected to an adjacent side wall 118, and each stabilizer end wall 146 is connected to an adjacent end wall 120. Each stabilizer top cap 148 connects adjacent stabilizer side and end walls 144 and 146 so that they are spaced from one another.

Figure 8:
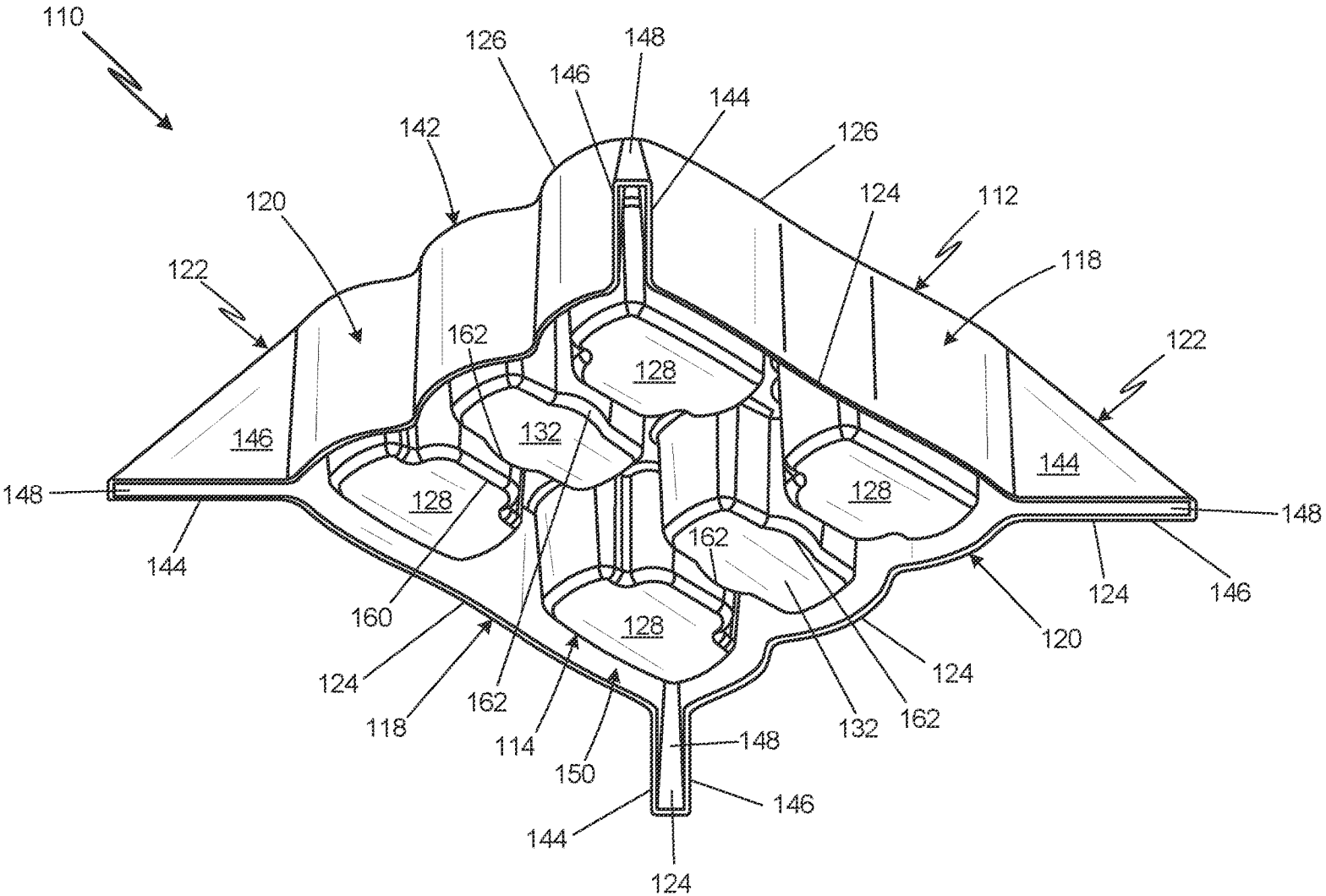
FIG. 8 is an isometric view showing an under side of the caddy of FIG. 7.

FIG. 8 shows caddy 110 from below, so that the under sides of outer shell 112 and inner shell 14 can be seen. Shown in FIG. 2 are caddy 110, outer shell 112, inner compartment 114, handle 116, side walls 118, end walls 120, stabilizers 122 (including stabilizer side wall 144, stabilizer end wall 146, and stabilizer top cap 148), bottom edge 124, top rim 126, corner pockets or cups 128, end pockets 132, and lower dividers 136. Handle 116 includes handle mounts 138 and crossbar 140. The double walled structure formed by outer shell 112 and inner compartment 114 is shown in FIG. 8. The double walled construction creates hollow space 150, which surrounds corner pockets 128, and end pockets 132, is contained by the inner surfaces of side walls 118, end walls 120, and walls 144 and 146 and top cap 148 of stabilizers 122. Hollow space 150 reduces that amount of material and therefore the overall weight of caddy 110. The double walled structure provides structural strength while reducing the amount of material needed to form caddy 110.

In one embodiment, caddy 110 is formed of a plastic material using a molding process, such as injection molding. In other embodiments, caddy 110 can be formed using other processes, such as rotomolding, 3D printing, compression molding, vacuum molding, and thermomolding. Caddy 110 can be made of any suitable plastic material, for example, a thermoplastic such as acrylonitrile butadiene styrene (ABS).

As shown in FIGS. 7 and 8, outer shell 112 (including side walls 118, end walls 120 and walls 144 and 146 of stabilizers 122) flares outward from top rim 126 to bottom edge 124. This increases the area encompassed by bottom edge compared to top rim 126 to provide stability to caddy 110. In addition, the flaring of outer shell 12, together with tapering of the outer surfaces of pockets 128 and 132 assists in removal of caddy 110 from the mold used to form caddy 110.

Caddy 110 has a double walled structure. This provides structural strength while reducing the amount of plastic material needed to form caddy 10. Reduction in the amount of plastic required reduces cost of materials. It also reduces the total weight of caddy 110, which is an advantage for the user.

Pockets 128 and 132 of inner compartment 114 can be any suitable shape or dimension, based on the particular items that will be carried in caddy 10. In some embodiments storage compartments are circles, rectangles, and/or rounded rectangles in order to conform to the shape of the items that are intended to be stored therein. Similarly, in some embodiments inner compartment 114 is configured to snugly fit the items that are intended to be stored therein, for example, car wax, cleaning wipes, spray bottles, rags, or sponges. Pockets 128 and 132 can be the same shape or different shapes to accommodate, for example, different bottle types. In the embodiment shown in FIGS. 7-12, each corner pocket 128 is a rounded rectangle which bulge 160 that protrudes toward an adjacent end pocket 132. Each end pocket 132 is a rounded rectangle with slight arcuate bulges 162 on each side protruding toward adjacent bulges 160 of corner pockets 128.

Figure 9:
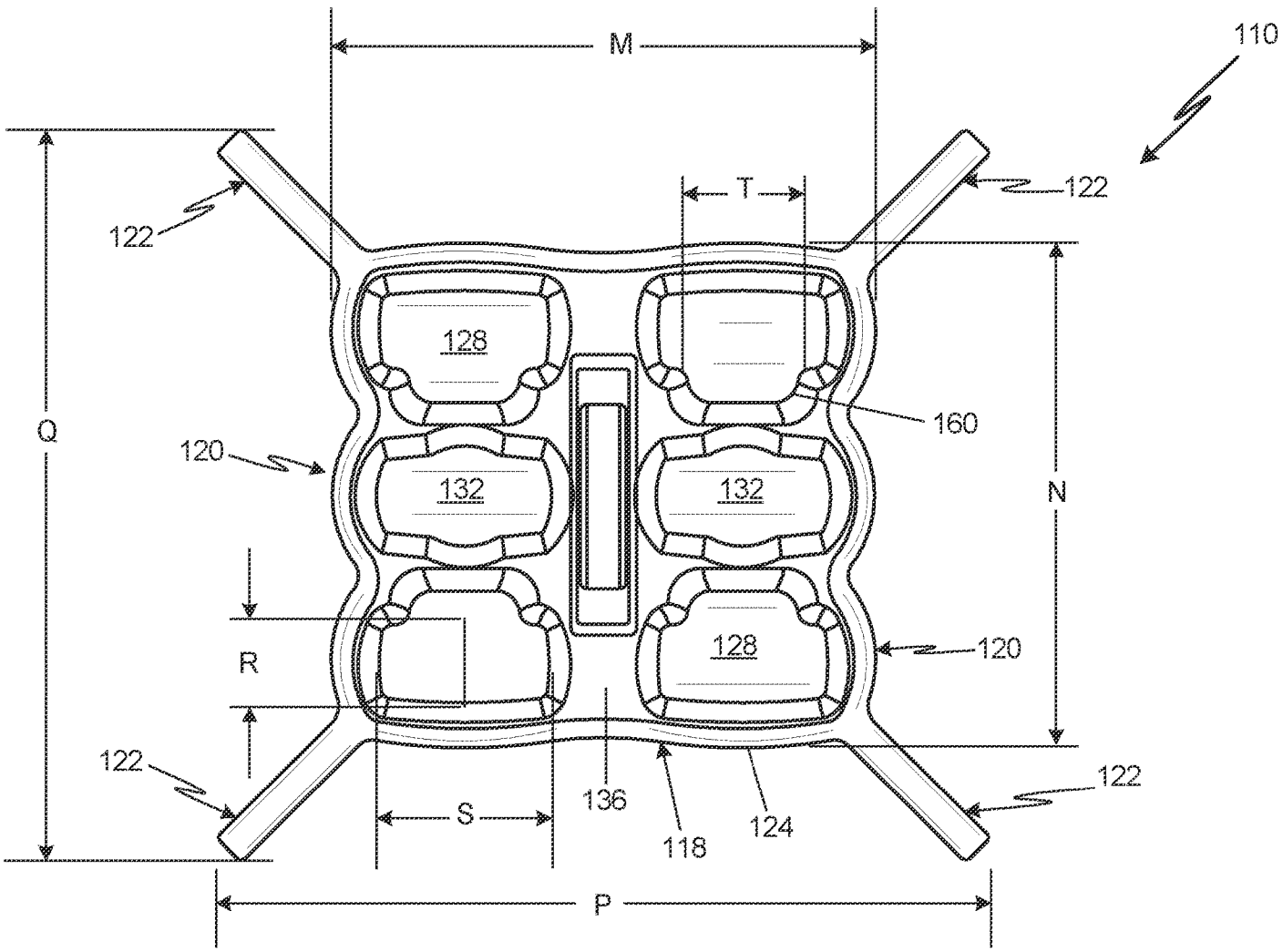
FIG. 9 is a top view of the caddy of FIG. 7.

FIG. 9 is a top view of caddy 110. Contouring of the inner walls, bottom of corner pockets 128, and end pockets 132 can be seen in FIG. 9. FIG. 9 shows dimensions M, N, P, and Q. Dimension M is a length between the outer surfaces of end walls 20. Dimension N is a width between the outer surfaces of side walls 118. Dimension P is a length between outer ends of two stabilizers 122 separated by side wall 118. Dimension Q is a width between outer ends of two stabilizers separated by end wall 120. Dimension R is a width corner pockets 128 and end pockets 132, excluding bulges 160 and 162, respectively. Dimension S is a length of each of corner packets 128 and end products 132. Dimension T is a length of bulges 160.

Figure 10:
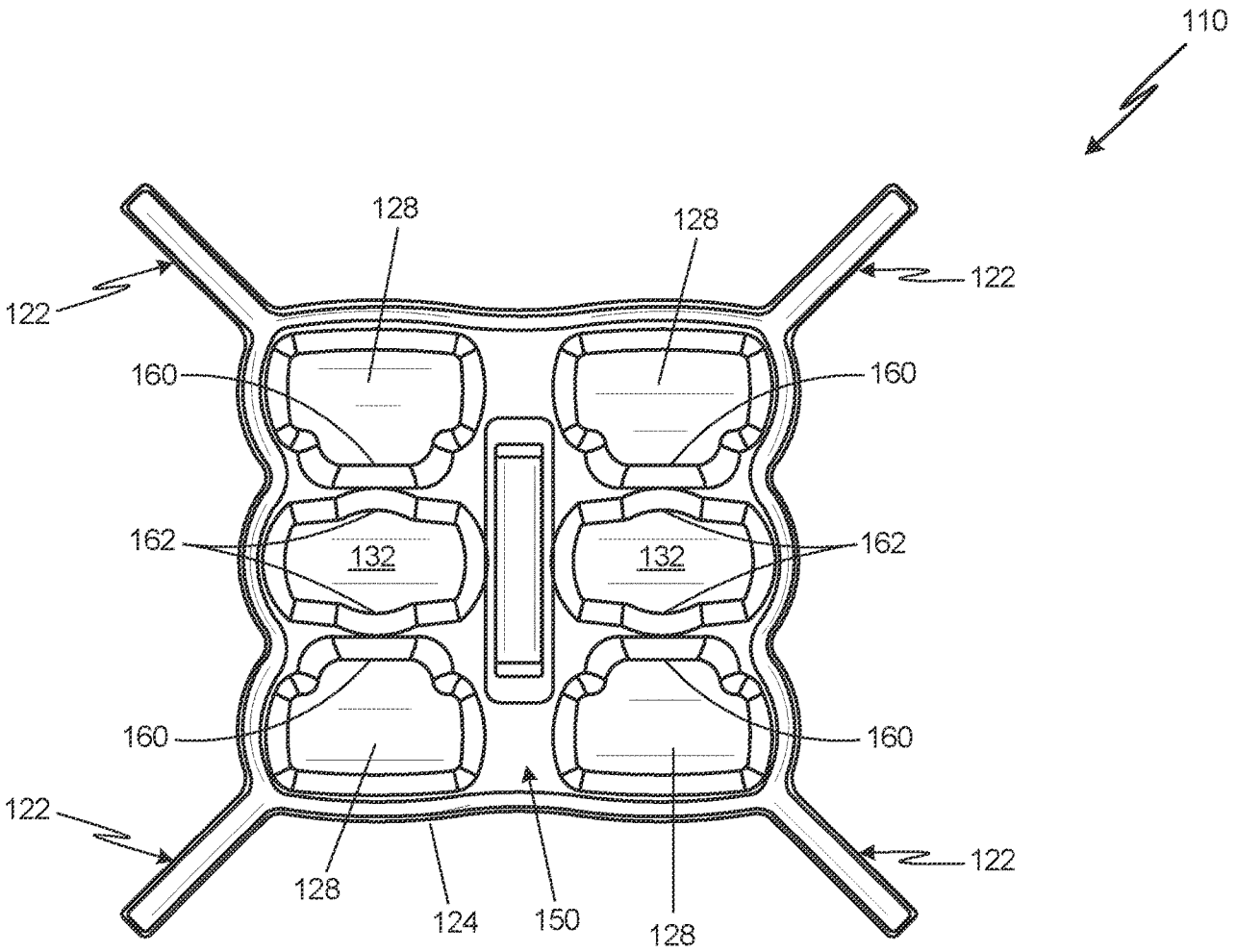
FIG. 10 is a bottom view of the caddy of FIG. 7.

FIG. 10 is a bottom view of caddy 110. Contouring of the outer walls and bottom of corner pockets 128 and end pockets 132 can be seen in FIG. 10.

Figure 11:
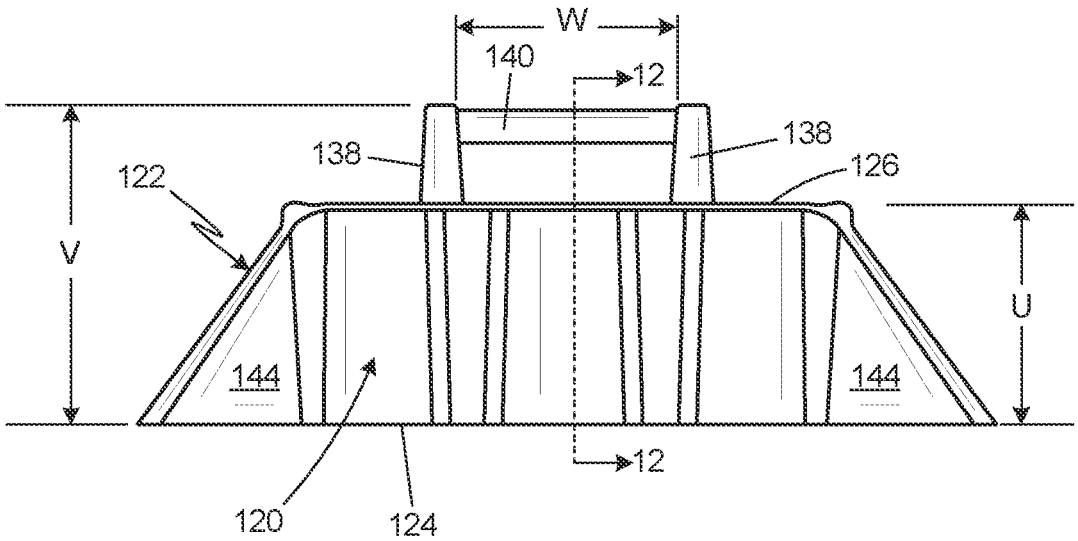
FIG. 11 is a side view of the caddy of FIG. 7.

FIG. 11 is a side view of caddy 110 showing end wall 120, stabilizers 122 at opposite ends of end wall 120, bottom edge 124, top rim 126, and handle mounts 138 and crossbar 140 of handle 116. FIG. 5 shows dimensions U-W. Dimension U is the height from bottom edge 124 to top rim 126. Dimension V is the height from bottom edge 124 to the top of handle 116. Dimension W is the length of crossbar 140 of handle 116.

Figure 12:
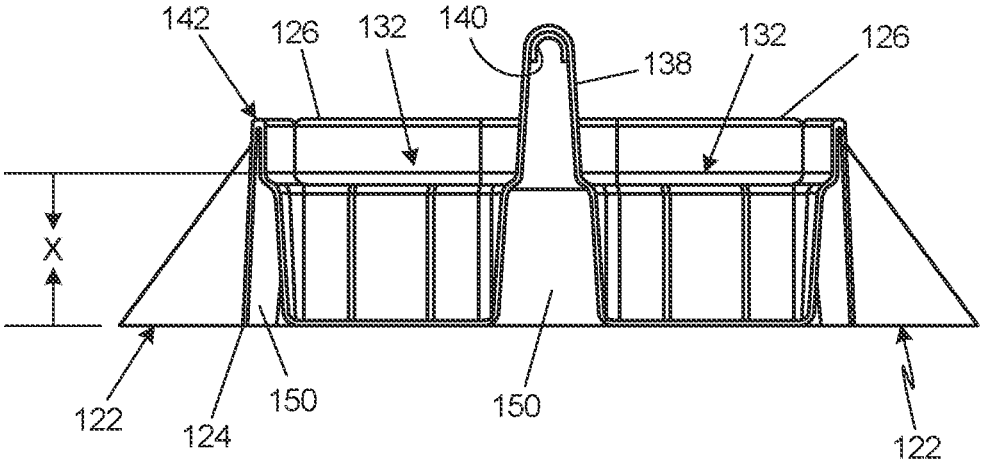
FIG. 12 is a sectional view of the caddy of FIG. 11 taken along line 12-12.

FIG. 12 is a sectional view of caddy 110 taken along section 6-6 of FIG. 11. FIG. 12 shows side walls 118, stabilizers 124, bottom edge 124, top rim 126, end pockets 132, handlebar 138, crossbar 140, walls 144 and caps 146 of stabilizers 122, and hollow space 150. FIG. 6 shows dimension L, which is the height of lowers dividers 136.

For example, in one embodiment, dimension M is 13 9/16 inches; dimension N is 12¼ inches; dimension P is 19 inches, and dimension Q is 17 13/16, inches. Dimension R is 2¼ inches, and dimension S is 4 9/16 inches; and dimension T is 2⅞ inches. Dimension U is 5½ inches; dimension V is 6½ inches; dimension W is 4½ inches; and dimension X is 3⅛ inches. Arcuate bulges 162 are based upon a circle having a diameter of 2¾ inches. Crossbar 140 of handle 116 has a width of 13/16 inch.

Based upon dimensions M and N, the area defined by the four corners of caddy 110 excluding stabilizers 122 is about 166 square inches. In contrast, based upon dimensions P and Q, the area defined by the four outermost ends of stabilizers 122 is about 338 square inches. The area defined by the outer most corners of stabilizers 122 is 2.04 times larger than the same caddy without stabilizers 122. This larger support base created by stabilizers 122 provided enhanced stability for caddy 110.

Stabilizers 122 effectively lengthen and widen the base of the caddy 110, which prevents lateral forces (e.g. braking, accelerating, etc.) from causing caddy 10 toppling over. Stabilizers 122 are shown in FIGS. 7-12 as having a triangular shape, but stabilizers 122 can take a variety of shapes so long as the outmost ends of the stabilizers both wide and lengthen the effective base area of caddy 110. Examples of other stabilizer structures include outriggers and buttresses. Although stabilizers 122 are shown as having a 45 degree angle with respect to top rim 126, the angle can be varied, for example between about 40 degrees and about 50 degrees. Increasing the angle will result in an increase in the distance stabilizers extend outward from the corners, and thus will increase the effective base area defined by stabilizers 122. Reducing the angle will have an opposite effect.

When in use, the empty or full caddy 110 is placed with bottom edge 124 on a relatively flat surface, for example, a trunk floor or a shelf of a rolling cart. Items to be transported are placed in the storage compartment or compartments in an upright position. The transportation method (car, dolly, cleaning cart, etc.) can then be moved. While in transport, the buttresses stabilize the caddy, preventing it and the items being transported from tipping over, despite the items making caddy 110 top heavy, and liquids causing major shifts in the center of gravity during transport. Because stabilizers 122 are narrow, other items can be packed around the caddy with few restrictions beyond the perimeter of caddy 110.

FIGS. 13A-27 show caddy system 208 including caddy 210, removable stabilizers 222 and removable bumpers 252. Caddy system 208 has caddy 210 with six pockets that can filled with spray bottles, aerosol cans, towels, tools, and other objects. Caddy 210 shown in FIGS. 13A-18 has a similar overall structure and design to caddy 110 shown in FIGS. 7-12. However, caddy 210 has removable stabilizers 222 and bumpers 252. Removable stabilizers 222 and bumpers 252 can also be incorporated in an eight-pocket caddy design (for example, caddy 10 shown in FIGS. 1-6). The reference numerals that refer to parts of caddy 210 are incremented by one-hundred compared to the reference numerals that refer to parts of caddy 110 shown in FIGS. 7-12.

Figure 13A:
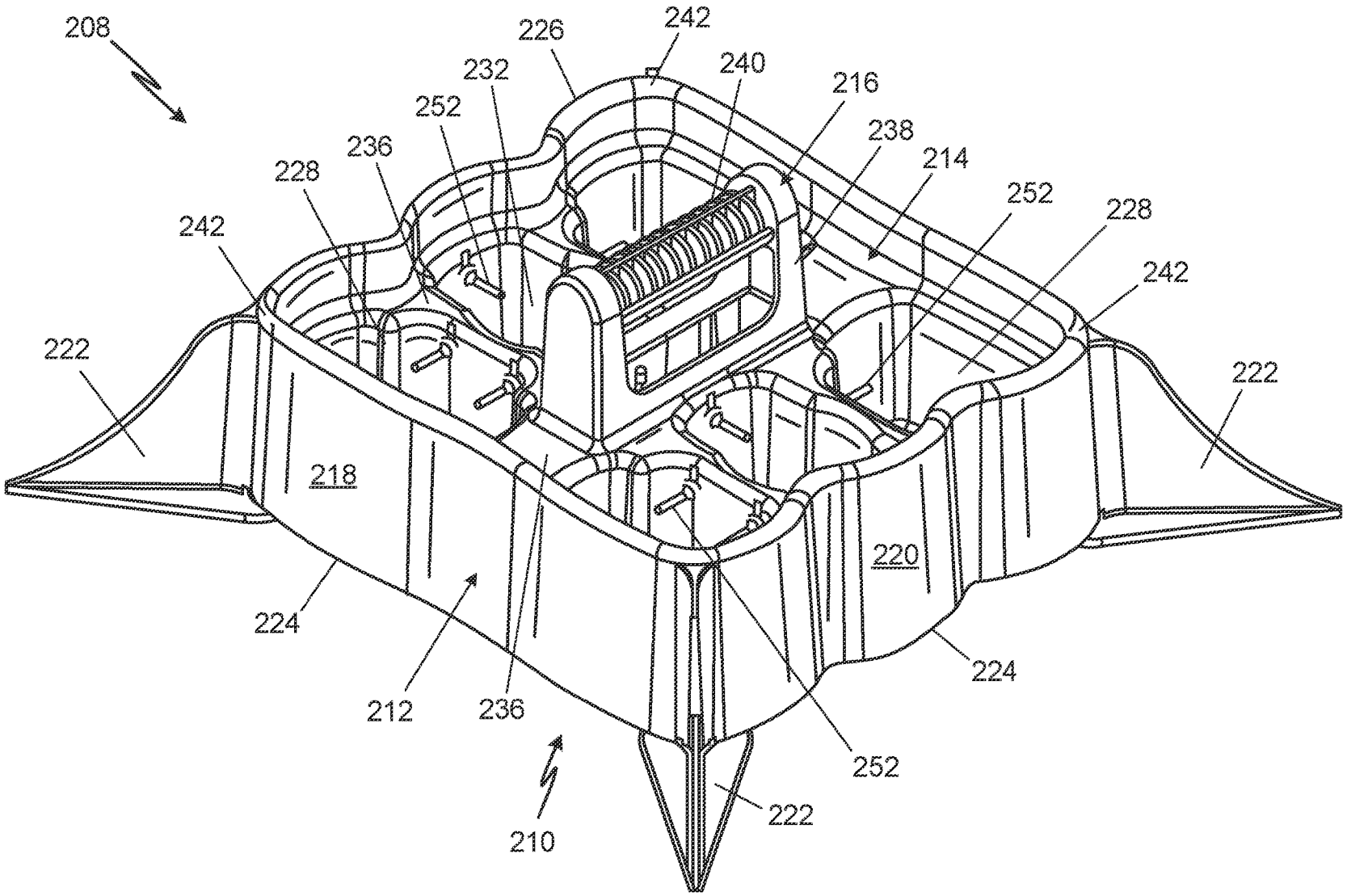
FIG. 13A is an isometric view showing an upper side of a caddy system having a caddy, removable stabilizers, and removable bumpers.
Figure 13B:
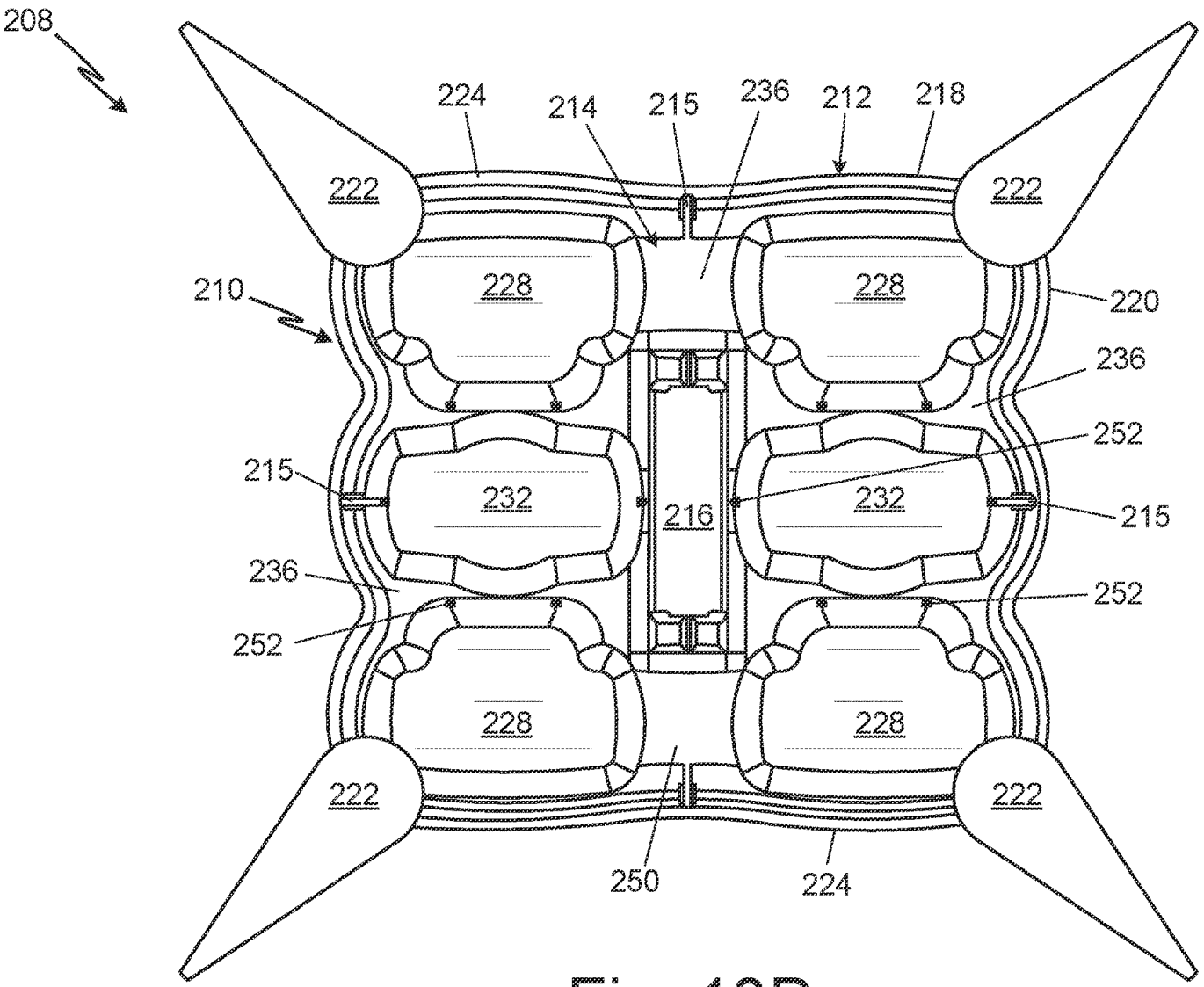
FIG. 13B is a bottom view of the caddy system of FIG. 13A.

FIG. 13A shows an upper side of caddy system 208. FIG. 13B shows an underside of caddy system 208. FIGS. 13A-13B will be discussed together. Caddy system 208 includes caddy 210 with stabilizers 222 and bumpers 252 connected. Caddy 210 includes outer shell 212, inner compartment 214, ribs 215 (shown in FIG. 13B), and handle 216. Outer shell 212 has side walls 218, end walls 220, bottom edge 224, and top rim 226 (shown in FIG. 13A). Inner compartment 214 includes corner pockets 228, end pockets 232, and lower dividers 236. Handle 216 includes handle mounts 238 (shown in FIG. 13A) and crossbar 240 (shown in FIG. 13A). Outer shell 212 also has four corners 242. Caddy 210 also includes hollow space 250 (shown in FIG. 13B).

Caddy 210 has outer shell 212 positioned around inner compartment 214. Handle 216 is near a middle of inner compartment 214. Side walls 218 and end walls 220 make up four sides of caddy 210. Side walls 218 are positioned across from one another. End walls 220 are positioned across from one another and between side walls 218. Handle 216 is oriented perpendicular to side walls 218 and parallel to end walls 220. Handle 216 connects to inner compartment 214 with handlebar mounts 238. Crossbar 240 runs between handle mounts 238 to create a place to hold and carry caddy 210.

Outer shell 212 has four corners 242 located where side walls 218 meet end walls 220. Bottom edge 224 is a bottom surface of outer shell 218. Top rim 226 is opposite bottom edge 224. Top rim 226 connects outer shell 218 to inner compartment 214. Ribs 215 are located between outer shell 212 and inner compartment 214 near top rim 226 to make caddy 210 more sturdy. Outer shell 212 (including side walls 218 and end walls 220 of outer shell 212) flares outward from top rim 226 to bottom edge 224. This increases the area encompassed by bottom edge 24 compared to top rim 26 to provide stability to caddy 10. In addition, the flaring of outer shell 12, together with tapering of the outer surfaces of pockets 28, 30, and 32 assists in removal of caddy 10 from the mold used to form caddy 10.

Inner compartment 214 includes corner pockets 228 located near corners 242. End pockets 232 are between corner pockets 228 adjacent to end walls 220. Lower dividers 236 separate corner pockets 228 from other corner pockets 228 and end pockets 232. Corner pockets 228 and end pockets 232 of inner compartment 214 can be any suitable shape or dimension, based on the particular items that will be carried in caddy system 208. In some embodiments, storage compartments are circles, rectangles, and/or rounded rectangles to conform to the shape of the items that are intended to be stored therein. Similarly, in some embodiments inner compartment 214 is configured to snugly fit the items that are intended to be stored therein, for example, car wax, cleaning wipes, aerosol cans, spray bottles, rags, and/or sponges. Corner pockets 228 and end pockets 232 can be the same shape or different shapes to accommodate, for example, different bottle types.

Caddy 210 includes corner pockets 228 and end pockets 232 that narrow from top rim 226 to a bottom of the pockets 228 and 232. Corner pockets 228 and end pockets 232 include a compound bevel between top rim 226 and a bottom of the pocket. Pockets 228 and 232 also taper between a top of each pocket 228 or 232 even with lower dividers 236 to a bottom of each pocket 228 or 232. Corner pockets 228 and end pockets 232 have bottoms flush with bottom edge 224 of outer shell 212. The bottoms of pockets 228 and 232 like in the same plane as a bottom surface of bottom edge 224. This increases the stability of caddy 210.

Figure 17:
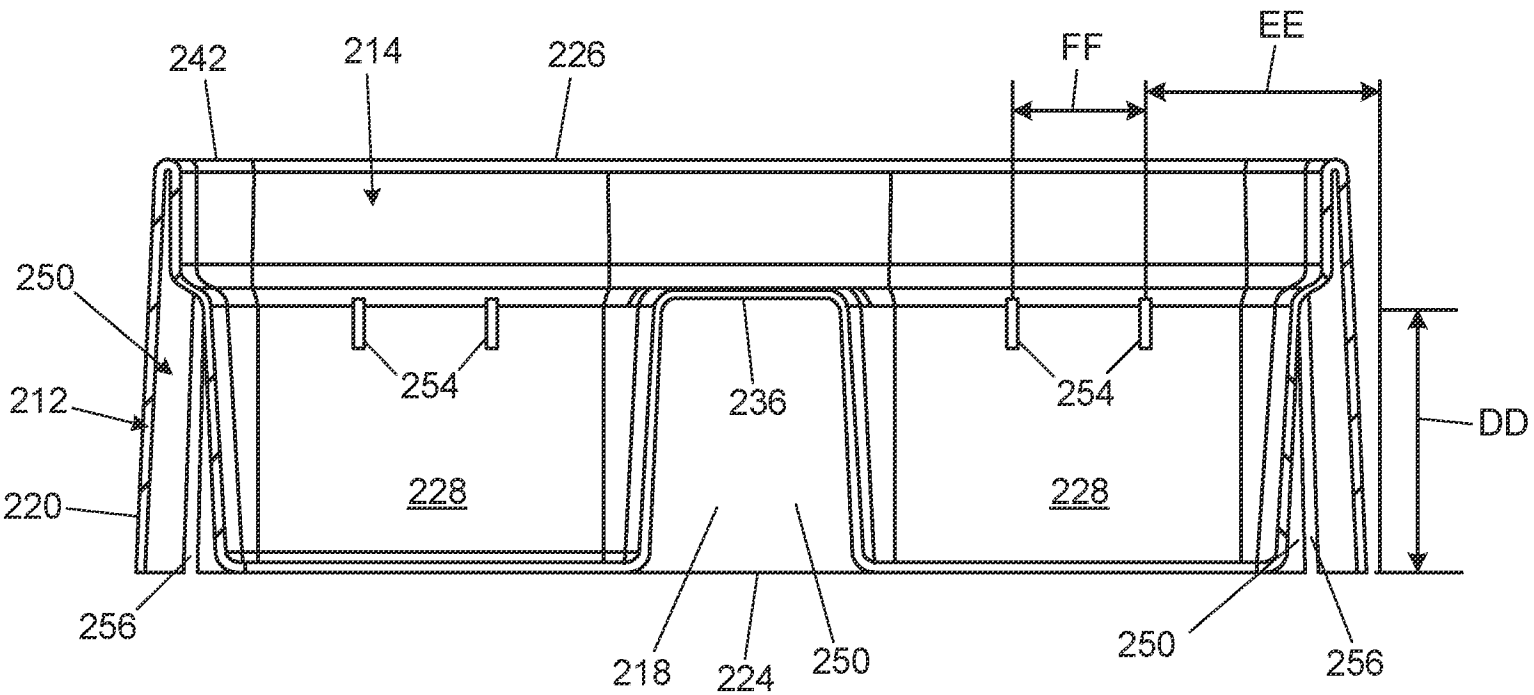
FIG. 17 is a cross-sectional view of the caddy taken along line 17-17 of FIG. 16A.
Figure 18:
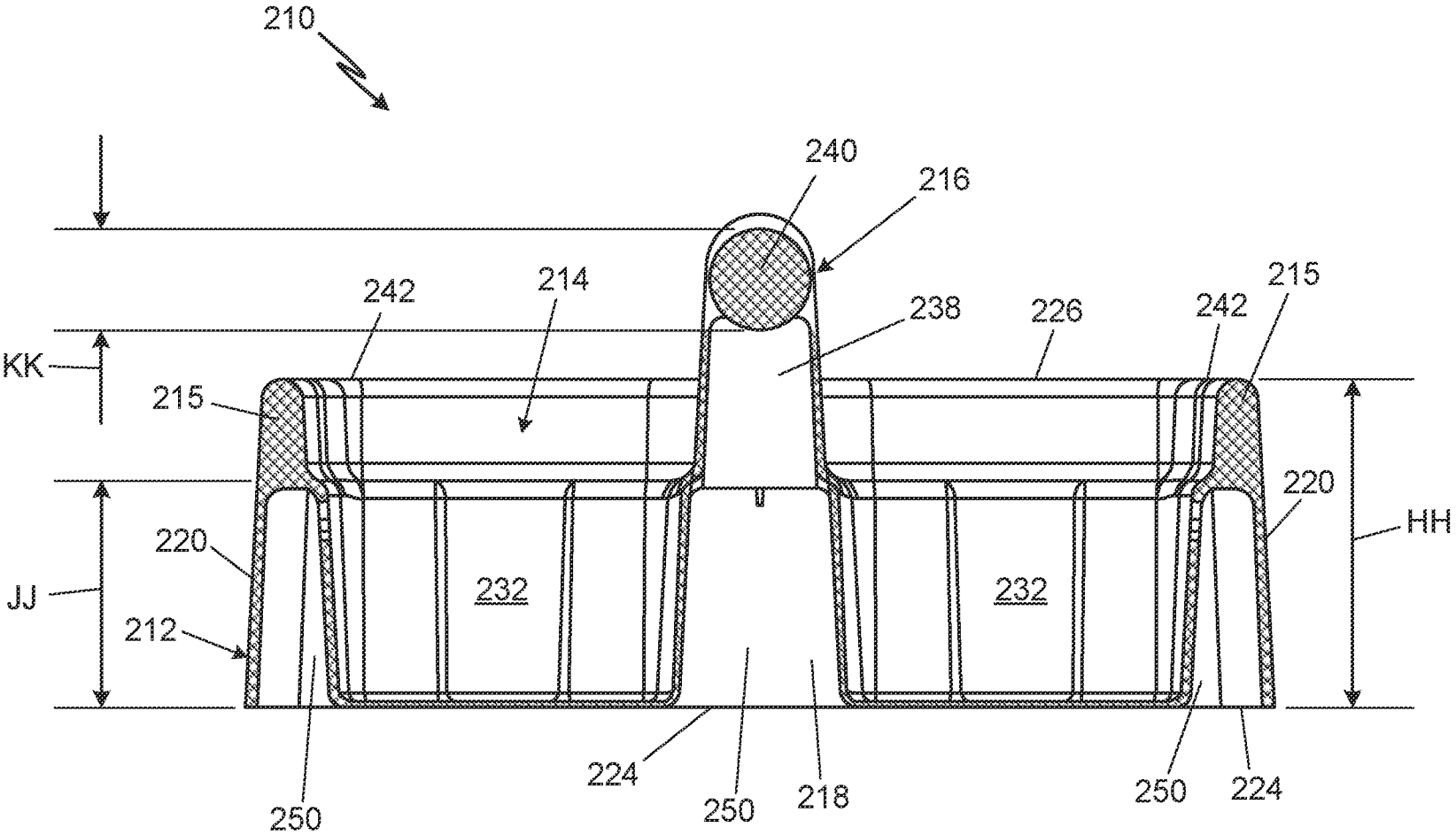
FIG. 18 is a cross-sectional view of the caddy taken along line 18-18 of FIG. 16B.

Caddy 210 also has a double walled structure creating hollow space 250 between outer shell 212 and inner compartment 214 and surrounding inner compartment 214. As shown in FIGS. 17-18, hollow space 250 has a generally triangular shape between outer shell 212 and inner compartment 214 due to outer shell 212 flaring outward from top rim 226 to bottom edge 224. Hollow space 250 also has a generally triangular shape within inner compartment 214 due to pockets 228 and 232 narrowing from a top to a bottom. Hollow space 250 provides structural strength while reducing the amount of plastic material needed to form caddy 210. Reduction in the amount of plastic required reduces cost of materials and the total weight of caddy 210.

In one embodiment, caddy 210 is formed of a plastic material using a molding process, such as injection molding. In other embodiments, caddy 210 can be formed using other processes, such as rotomolding, 3D printing, compression molding, vacuum molding, and thermomolding. Caddy 210 can be made of any suitable plastic material, for example, a thermoplastic such as acrylonitrile butadiene styrene (ABS).

In FIGS. 13A-13B, caddy system 208 is assembled with stabilizers 222 connected at corners 242 of caddy 210. Stabilizers 222 are separate from outer shell 212 and are removable from caddy 210. Each stabilizer 222 fits into a stabilizer mounting slot 256 (shown in FIGS. 14A-19 and discussed below). Each stabilizer 222 is interchangeable with every other stabilizer 222 in that a single stabilizer 222 can connect to any of the corners 242. Stabilizers 222 extend outward and downward from corners 242. FIGS. 13A-13B show how stabilizers 222 effectively lengthen and widen the base of caddy 210 by extending outward beyond side walls 218 and end walls 220. A longer and wider base prevents lateral forces (e.g. braking, accelerating, etc.) from causing caddy 10 to topple over, thus preventing spilling any items stored in pockets 228 and 232. Stabilizers 222 are shown in FIGS. 13A-13B as having a stylized triangular shape, but stabilizers can take a variety of shapes so long as the outmost ends of the stabilizers both widen and lengthen the effective base area of caddy 210. Examples of other stabilizer structures include outriggers and buttresses. Stabilizers 222 are made of soft rubber (or similar materials) to prevent caddy system 208 (specifically bottom edge 224 of outer shell 212 and the bottoms of pockets 228 and 232) from scratching and/or damaging surfaces on which caddy 210 is placed.

When in use, the empty or full caddy 210 is placed with a bottom of each stabilizer 222 on a relatively flat surface, for example, a trunk floor or a shelf of a rolling cart. Items to be transported are placed in corner pockets 228 and/or end pockets 232 in an upright position. The transportation method (car, dolly, cleaning cart, etc.) can then be moved with less risk of caddy 210, and the items within, from toppling over, despite the items in caddy 210 top heavy and causing major shifts in the center of gravity during transport.

Stabilizers 222 are narrow, which allows other items to be packed around caddy system 208 with few restrictions beyond the perimeter of caddy 210. Caddy system 208 allows for a user to custom configure and adapt caddy system 208 to different environments by using less than four of stabilizers 222. For example, one stabilizer 222 can be used and caddy 210 could be placed in a corner of a rolling cart to allow more space in the cart for other items. In another example, all four stabilizers 222 can be removed to store caddy 210 more easily. Custom configurations of caddy 208 allow for caddy 210 to be secured by stabilizers 222 in any environment.

In FIGS. 13A-13B, caddy system 208 is assembled with bumpers 252 positioned in corner pockets 228 and end pockets 232. Bumpers 252 are anchored into inner compartment 214 through bumper mounting slots 254 (shown in FIGS. 14A-14B and 16-17) in sides of corner pockets 228 and end pockets 232. Bumpers 252 extend generally perpendicularly from the sides of corner pockets 228 and end pockets 232, as seen in FIG. 13A. Bumpers 252 have heads which extend into hollow space 250 of caddy 210 (as seen in FIG. 13B) to firmly hold bumpers 252 in caddy 210. Bumpers 252 are made of soft rubber and help grip items placed into corner pockets 228 and end pockets 232. Bumpers 252 effectively reduce the size of corner pockets 228 and end pockets 232 so items, like aerosol cans and spray bottles, securely fit into corner pockets 228 and end pockets 232. Each pocket 228 and 232 can have a specifically designed bumper 252 to best secure items like aerosol cans and spray bottles.

Having removable stabilizers 222 and bumpers 252 in caddy system 210 allows a consumer to purchase individual replacement parts. For example, if caddy 210 were to crack, a consumer could replace caddy 210 and use the stabilizers 222 and bumpers 252 from the broken caddy. Similarly, if bumpers 252 or stabilizers 222 were to break, a consumer could buy replacement stabilizers 222 or bumpers 252 and use with the old caddy 210. This creates an economic option for consumers, making caddy system 208 more desirable.

Figure 14A:
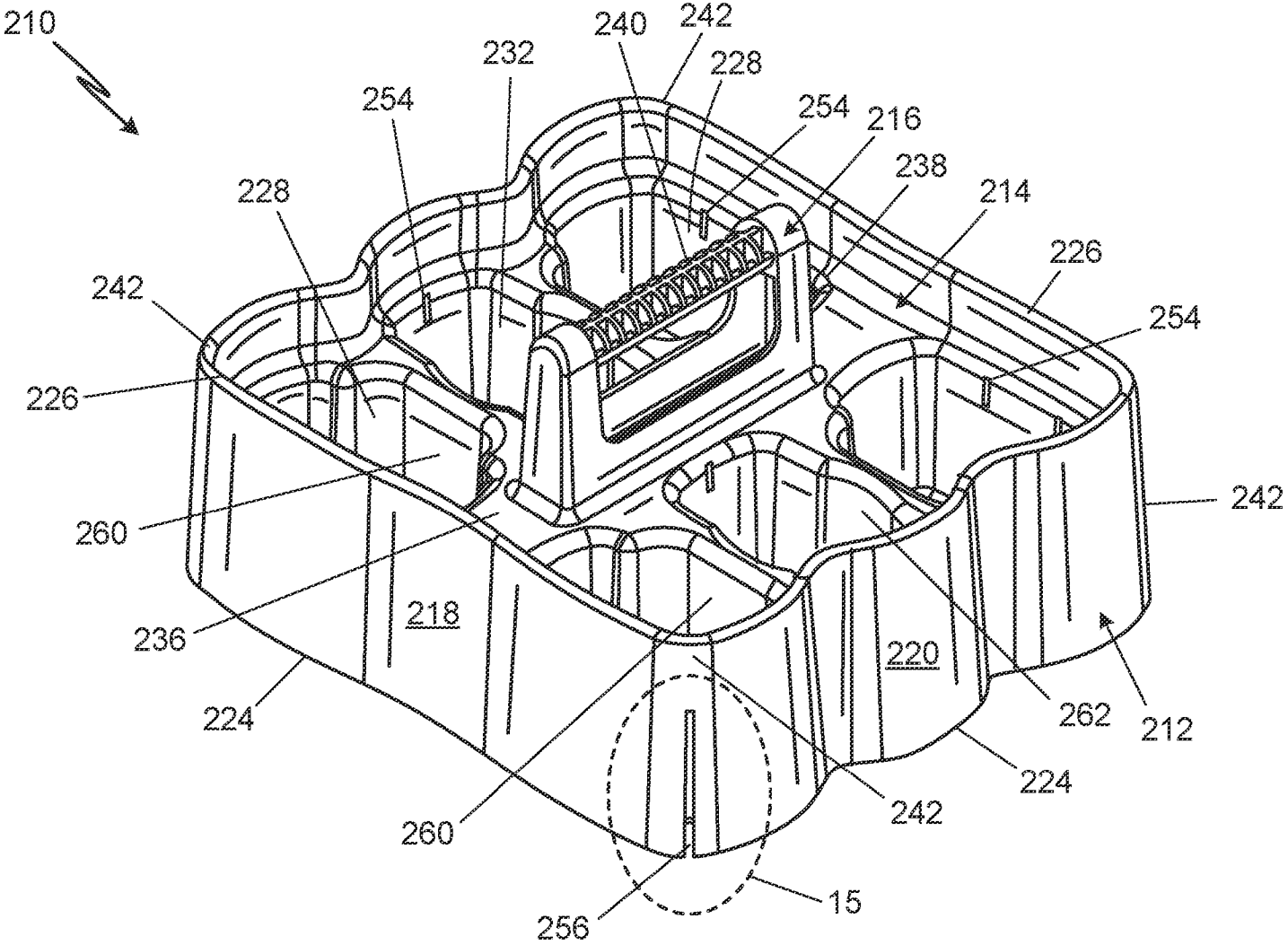
FIG. 14A is an isometric view showing an upper side of the caddy shown in FIGS. 13A-13B.
Figure 14B:
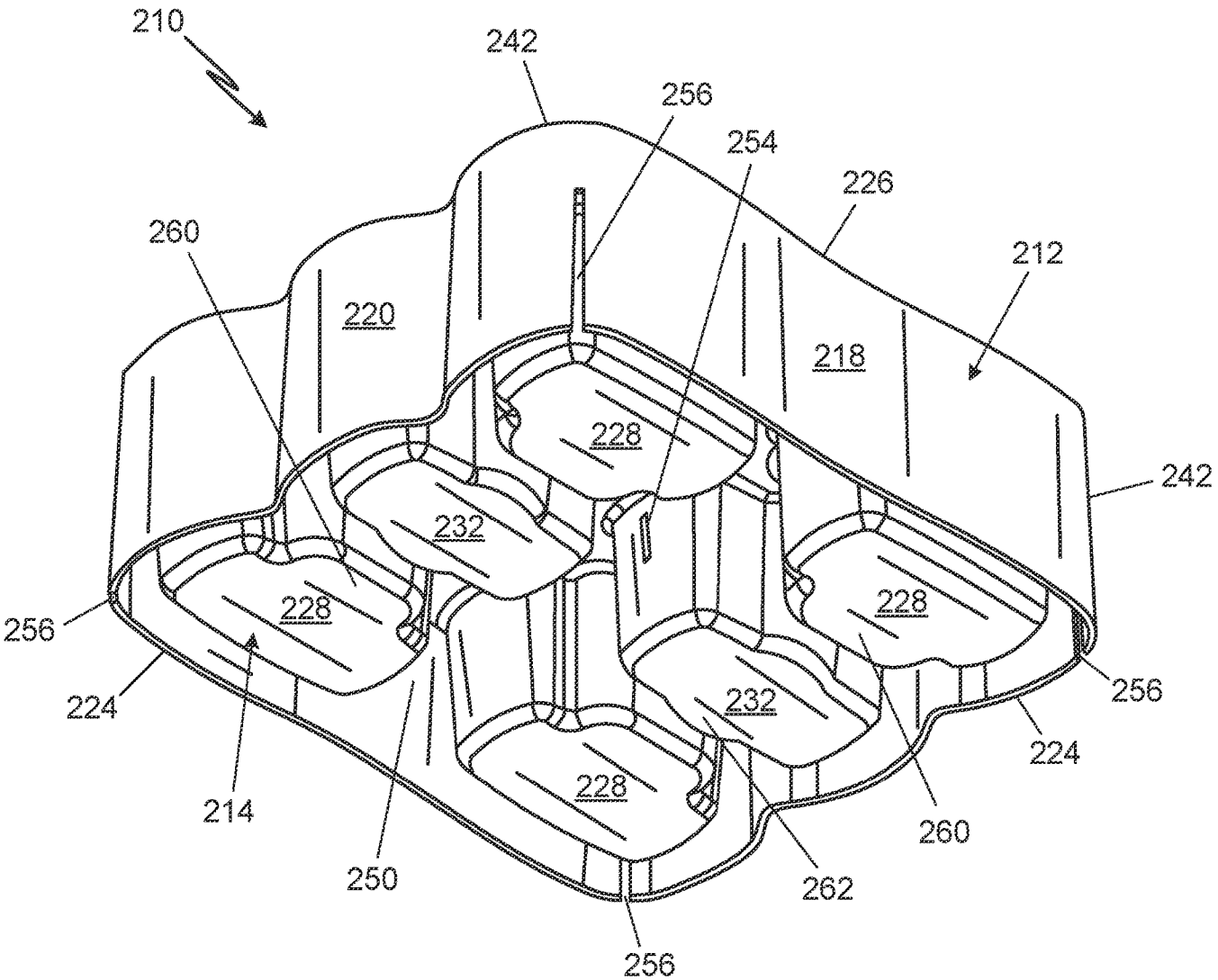
FIG. 14B is an isometric view showing an under side of the caddy shown in FIGS. 13A-13B.

FIG. 14A is an isometric view of an upper side of caddy 210. FIG. 14B is an isometric view of an under side of caddy 210. FIGS. 14A-14B shows caddy 210 as discussed in relation to FIGS. 13A-13B, including outer shell 212 with side walls 218, end walls 220, bottom edge 224, and top rim 226; inner compartment 214 with corner pockets 228, end pockets 232, and lower dividers 236; handle 216; and hollow space 250. FIGS. 14A-14B show bumper mounting slots 254, stabilizer mounting slots 256, bulge 260 in corner pockets 228, and bulge 262 in end pockets 232. FIG. 14A also shows oval 15 around one stabilizer mounting slot 256.

In the embodiment shown in FIG. 14A, corner pockets 228 and end pockets 232 are shaped as rounded rectangles. To achieve this rounded shape, corner pockets 228 have bulge 260 in a side of corner pocket 228 adjacent to end pocket 232. End pockets have bulges 262 adjacent to corner pockets 228. Bulges 260 and 262 increase the size of corner pockets 228 and end pockets 232, respectively, allowing for rounded bottles or irregular shaped items to fit into inner compartment 214 of caddy 210.

Bumper mounting slots 254 are rectangular holes cut inner compartment 214. Bumper mounting slots 254 are in the sides of corner pockets 228 and end pockets 232. Bumper mounting slots 254 can be located anywhere in the pockets depending on where a bumper would be useful to grip and hold products in corner pockets 228 and end pockets 232. In the embodiment of caddy 210 shown in FIG. 14A, two bumper mounting slots 254 are opposite bulges 260 in corner pockets 228. In end pockets 232, two bumper mounting slots 254 are located opposite one another in sides of end pockets 232 without bulges 262. Caddy 210 can have any positive, non-zero integer N number of bumper mounting slots 254. Bumper mounting slots 254 are sized to securely hold bumpers 252 (shown in FIGS. 13A-13B) in inner compartment 214 while items are being placed in and removed from corner pockets 228 and end pockets 232.

Stabilizer mounting slots 256 are in each corner 242 of outer shell 218. Stabilizer mounting slots 256 are tapered gaps in corners 242. Bottoms of stabilizer mounting slots 256 form a gap in bottom edge 224 and are wider than tops of stabilizer mounting slots 256. Stabilizers 222 (shown in FIGS. 14A-14B) can be slid into stabilizer mounting slots 256. The tapered shape allows the narrower tops of stabilizer mounting slots 256 to firmly hold stabilizers 222 in position on caddy 210. As discussed above in relation to FIGS. 13A-13B, stabilizers 222 increase the surface area covered by caddy 210 to reduce the likelihood of tipping.

Figure 15:
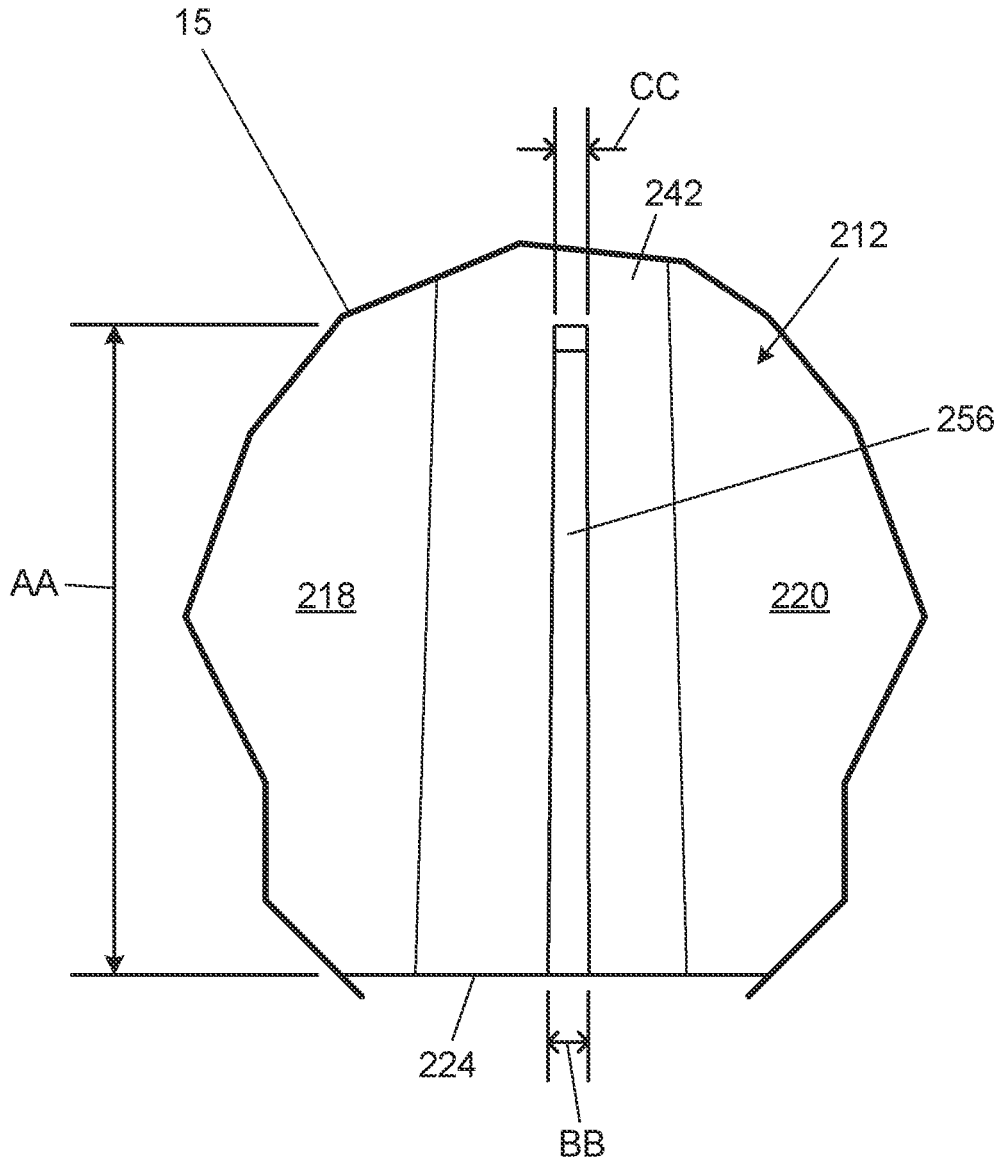
FIG. 15 is an enlarged view of section 15 of FIG. 14A.

FIG. 15 is an enlarged view of oval 15 in FIG. 14A. FIG. 15 shows one corner 242 of caddy 210 (shown in FIG. 14A). Section 15 includes outer shell 212, side wall 218, end wall 220, bottom edge 224, corner 242, and stabilizer mounting slot 256. FIG. 15 also includes dimension AA, dimension BB, and dimension CC.

Stabilizer mounting slot 256 is an oblong slot in outer wall 212. Stabilizer mounting slot 256 is in corner 242 between side wall 218 and end wall 220. One stabilizer mounting slot 256 is in each corner 242. Stabilizer mounting slot 256 extends upwards from bottom edge 224 toward top rim 226 (shown in FIGS. 14A-14B). Stabilizer mounting slot 256 has a length of dimension AA, which can be between 3.060 inches and 2.940 inches. Dimension AA is preferably 3.00 inches. A bottom of stabilizer mounting slot 256 creates a gap in bottom edge 224. The bottom of stabilizer mounting slot 256 has a width of dimension BB, which can be between 0.178 inches and 0.198 inches. Dimension BB is preferably 0.188 inches. FIG. 15 shows stabilizer mounting slot 256 is tapered at angle CC so the bottom is wider than a top of stabilizer mounting slot 256. Angle CC can be between 0.1 degrees and 2.0 degrees. Angle CC is preferably 1.0 degree.

Stabilizer mounting slot 256 is designed to mate with stabilizers 222 (shown in and discussed in relation to FIGS. 22-28) and firmly hold stabilizers 222 in place when caddy system 208 is assembled, as shown in FIGS. 13A-13B. Tapering stabilizer mounting slots 256 creates a tight fit at the top of stabilizer mounting slots 256 and stabilizers 222. The wider bottom of stabilizer mounting slot 256 allows stabilizers 222 to easily begin sliding into place.

Figure 16A:
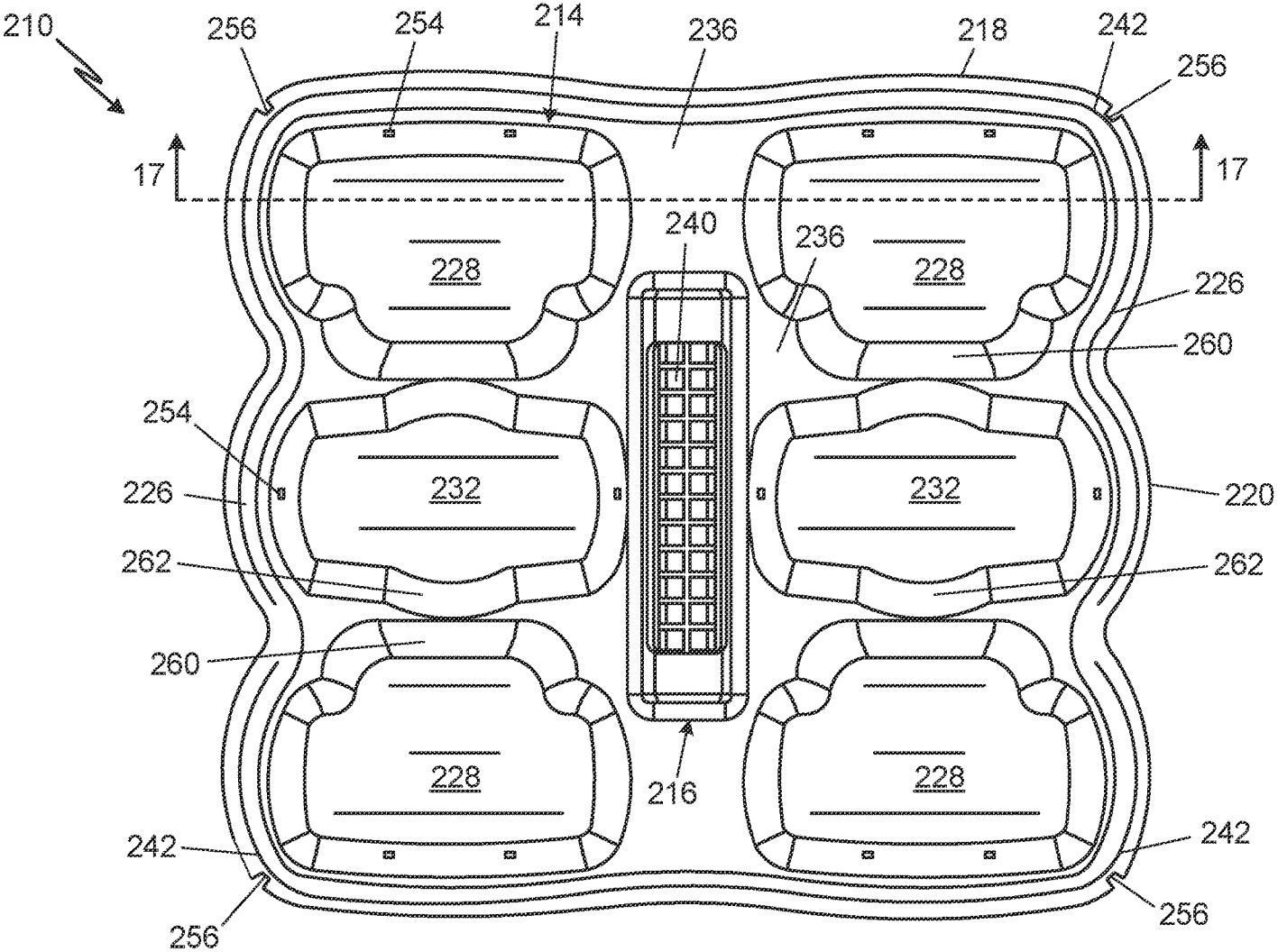
FIG. 16A is a top view of the caddy of FIGS. 14A-14B.
Figure 16B:
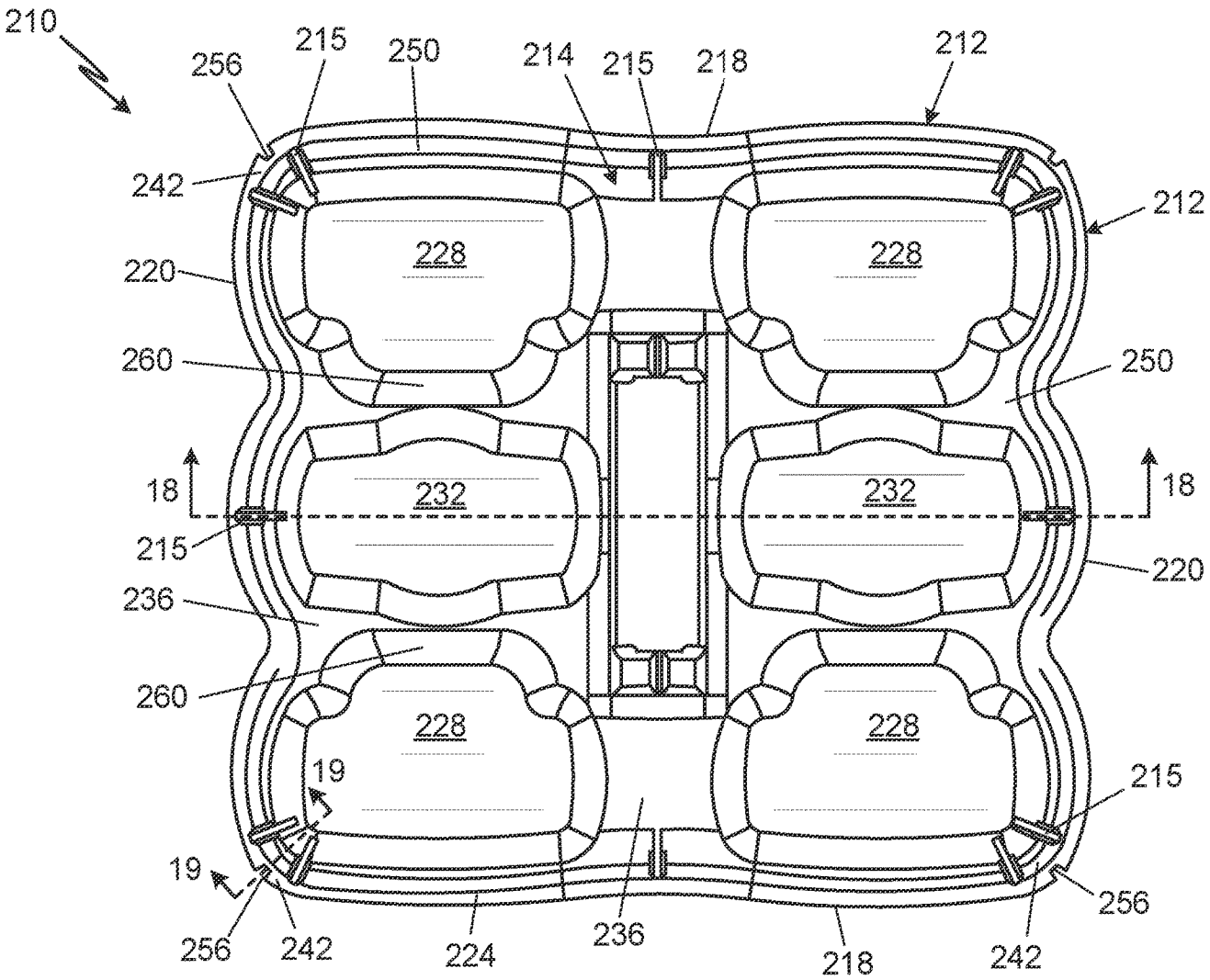
FIG. 16B is a bottom view of the caddy of FIGS. 14A-14B

FIG. 16A is a top view of caddy 210 of FIGS. 14A-14B. FIG. 16B is a bottom view of caddy 210 of FIGS. 14A-14B. Caddy 210 in FIGS. 16A-16B has a similar overall structure and design to caddy 210 shown in FIGS. 14A-14B. Caddy 210 includes outer shell 212, inner compartment 214, ribs 215 (shown in FIG. 16B), handle 216, side walls 218, end walls 220, bottom edge 224, top rim 226, corner pockets 228, end pockets 232, lower dividers 236, handle mounts 238 (shown in FIG. 16A), crossbar 240 (shown in FIG. 16A), hollow space 250 (shown in FIG. 16B), bumper mounting slots 254 (shown in FIG. 16A), stabilizer mounting slots 256, bulges 260, and bulges 262. FIG. 16A also includes line 17-17. FIG. 16B includes line 18-18 and line 19-19.

FIGS. 16A-16B shows lower dividers 236 between corner pockets 228 and end pockets 232. Lower dividers 236 define corner pockets 228 and end pockets 232. Lower dividers 236 are on each side of corner pockets 228 and each side of end pockets 232. Lower dividers 236 create a flat portion in inner compartment 214 that is vertically higher than both bottom edge 224 and bottoms of corner pockets 228 and end pockets 232. Lower dividers 236 are lower than top rim 226 and crossbar 240 of handle 216.

FIGS. 16A-16B show the arrangement and shapes of corner pockets 228 and end pockets 232 in caddy 210. Corner pockets 228 are rounded rectangles. Each corner pocket 228 has three sides without a bulge and one side with bulge 260. The side of corner pockets 228 with bulge 260 is the side adjacent to end pockets 232. Each end pocket 232 has two sides with bulges 262 and two sides without a bulge. The two sides having bulges 262 of each of end pockets 232 are adjacent to corner pockets 228. The rounded rectangular shape of corner pockets 228 and end pockets 232 better fits round objects like bottles. The rounded rectangular shape also best utilizes the available area in inner compartment 214. Bulges 260 and bulges 262 help increase available storage space in corner pockets 228 and end pockets 232.

FIG. 16B shows hollow space 250. A double walled structure is formed by outer shell 212 and inner compartment 214 which creates hollow space 250. Hollow space 250, which surrounds corner pockets 228 and end pockets 232, is contained by the inner surfaces of side walls 218 and end walls 220 of outer shell 212. Hollow space 250 reduces the amount of material, and therefore the overall weight, of caddy 210. The double walled structure provides structural strength while reducing the amount of material needed to form caddy 210.

FIG. 16B also shows ribs 215. Ribs 215 are support structures between outer shell 212 and inner compartment 214 located near topo rim 226. Two ribs 215 are in each corner 242 of caddy 210 on either side of stabilizer mounting slot 256 to support outer shell 212 from collapsing or breaking when inserting stabilizers 222 (shown in FIGS. 13A-13B). One rib 215 is also located near a middle of each side wall 218 and connected to lower dividers 236 between corner pockets 228. These ribs 215 stabilize side walls 218 where outer shell 212 may be weaker due to the length between corners 242. One rib 215 is also located near a middle of each end wall 220 and connected to end pockets 232 between corner pockets 228. These ribs 215 stabilize end walls 220 where outer shell 212 may be weaker due to the length between corners 242.

FIG. 16A shows line 17-17 through corner pockets 228. Line 17-17 can be between handle mount 238 and side wall 218. FIG. 16B shows line 18-18 through end pockets 232 and handle 216. Line 18-18 is through a middle of caddy 210. FIG. 16B also shows line 19-19 through stabilizer mounting slot 256. Line 19-19 can be between two ribs 215 in a corner 242. Line 17-17, 18-18, and 19-19 denote cross-sections that will be discussed in FIGS. 17-19.

FIG. 17 is a cross-sectional view of caddy 210 taken along line 17-17 of FIG. 16A. FIG. 17 shows two corner pockets 228. Each corner pocket 228 has two bumper mounting slots 254. FIG. 17 also shows outer shell 212, inner compartment 214, side wall 218, end walls 220, bottom edge 224, top rim 226, lower dividers 236, hollow space 250, and stabilizer mounting slots 256. FIG. 17 also shows dimension DD, dimension EE, and dimension FF.

Bumper mounting slots 256 have a length from a top to a bottom between 0.365 inches and 0.385 inches 0.375. The length of bumper mounting slots 256 is preferably 0.375 inches. Bumper mounting slots 256 have a width from a side closest to lower divider 236 to a side closest to outer shell 212 between 0.19 inches and 0.21 inches. The width of bumper mounting slots 256 is preferably 0.20 inches. Bumper mounting slots 256 in end pockets 232 (shown in FIGS. 13A-14B) have the same length and width as in corner pockets 228. The length and width of bumper mounting slots 254 are designed to firmly hold bumpers 252 (shown in FIG. 13A).

Dimension DD is a distance between bottom edge 224 and a bottom of bumper mounting slots 254. Dimension DD is a distance between 2.32 inches and 2.56 inches. Dimension DD is preferably 2.50 inches. Dimension DD is the same for bumper mounting slots 256 in end pockets 230 (shown in FIG. 16A). Dimension EE is a distance between bottom edge 224 and the side of bumper mounting slot 256 closest to outer shell 212. Dimension EE can be between 2.32 inches and 2.34 inches. Dimension EE is preferably 2.38 inches. Dimension FF is a distance between bumper mounting slots 256. Dimension FF can be between 1.72 inches and 1.84 inches. Dimension FF is preferably 1.78 inches.

FIG. 18 is a cross-sectional view of caddy 210 taken along line 18-18 of FIG. 16B. FIG. 18 shows two end pockets 232 and a cross section of handle 216. FIG. 18 also shows outer shell 212, inner compartment 214, ribs 215, side wall 218, end walls 220, bottom edge 224, top rim 226, handle mount 238, crossbar 240, and hollow space 250. FIG. 18 also shows dimension HH, dimension JJ, and dimension KK.

Dimension HH is a distance between bottom edge 224 and top rim 226. Dimension HH is a height of caddy 210 without handle 216. Dimension HH can be between 4.44 inches and 4.56 inches. Dimension HH is preferably 4.50 inches. Dimension JJ is a distance between bottom edge 224 and a top of end pockets 232 (and corner pockets 228, shown in FIG. 17). Dimension JJ is a depth of end pockets 232 (and corner pockets 228, as shown in FIG. 17). Dimension JJ is a distance between 3.04 inches and 3.16 inches. Dimension JJ is preferably 3.10 inches. Dimension KK is a diameter of crossbar 240 of handle 216. Dimension KK can be between 1.65 inches and 1.85 inches. Dimension KK is preferably 1.75 inches.

Figure 19:
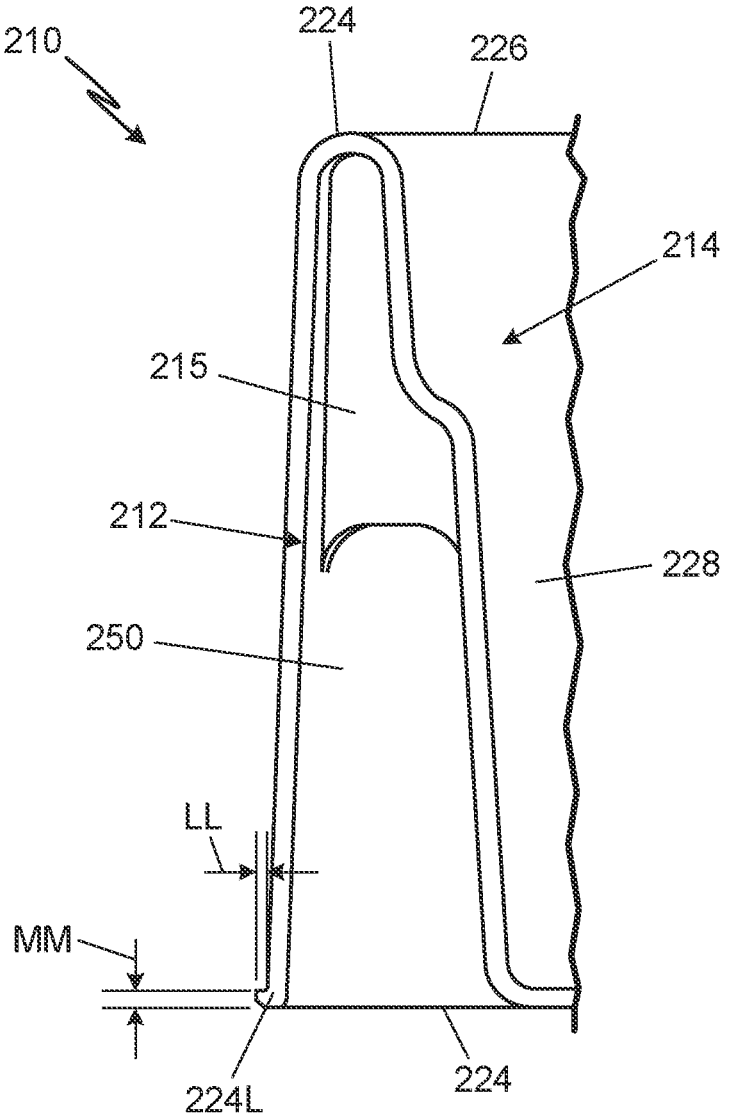
FIG. 19 is a cross-sectional view of the caddy taken along line 19-19 of FIG. 16B.

FIG. 19 is a cross-sectional view of caddy 210 taken along line 19-19 of FIG. 16B. FIG. 19 is a cross-section taken through a stabilizer mounting slot 256 in one corner 242 of caddy 210, as shown in FIG. 16B. FIG. 19 shows outer shell 212, inner compartment 214, rib 215, bottom edge 224 with lip 224L, top rim 226, corner pocket 228, and hollow space 250. FIG. 19 also shows dimension LL and dimension MM.

Lip 224L is a portion of bottom edge 224 that extends past outer shell 212. Lip 224L fits into a slot in stabilizer 322 (shown in FIGS. 26-28), which is an alternate embodiment of stabilizer 222. The slot in stabilizer 322 will be discussed in more detail in relation to FIGS. 26-28. Lip 224L holds onto stabilizer 322 when stabilizer 322 is in place in stabilizer mounting slot 256 (Shown in FIGS. 14A-14B). Dimension LL is a width of lip 224L that extends beyond outer shell 212 in corner 242. Dimension LL can be between 0.01 inches and 0.11 inches. Dimension LL is preferably 0.05 inches. Dimension MM is a height of lip 224L. Dimension MM can be between 0.04 inches and 0.16 inches. Dimension MM is preferably 0.10 inches.

Figure 20A:
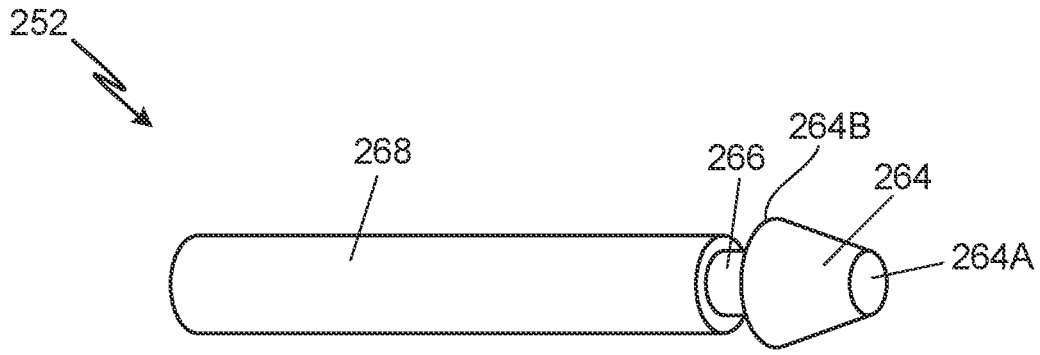
FIG. 20A is an isometric view of a first embodiment of a bumper designed to be positioned in the bumper mounting slots of the caddy shown in FIGS. 14A-14B.
Figure 20B:
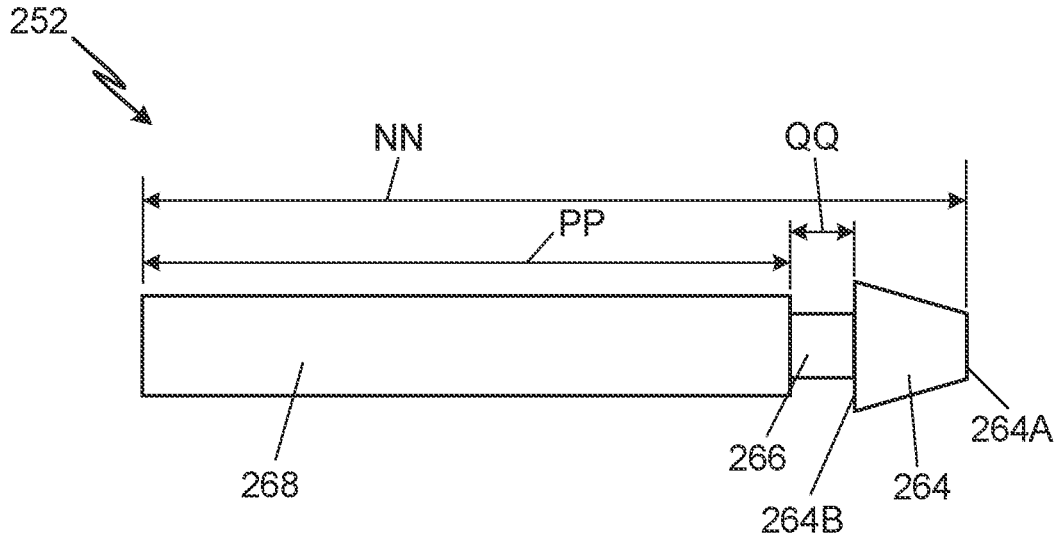
FIG. 20B is a side view of the bumper of FIG. 20A.

FIG. 20A is an isometric view of bumper 252 designed to be positioned in bumper mounting slots 254 of caddy 210 shown in FIGS. 14A-14B. FIG. 20B is a side view of bumper 252 of FIG. 20A. FIGS. 20A-20B will be discussed together. Bumper 252 includes head 264 with a first side 264A (shown in FIG. 20A) and a second side 264B (shown in FIG. 20A), neck 266, and body 268. FIG. 20B includes dimension OO, dimension PP, and dimension QQ.

Bumper 252 has head 264, neck 266, and body 268 arranged linearly from a first end at head 264 to a second end at body 268. In FIG. 20B, the first end is on a right side and the second end is on a left side. First side 264A of head 264 is at the first end of bumper 252. Head 264 has a beveled surface between first end 264B and second end 264B. The beveled surface gives head 264 a frustoconical shape. Neck 266 attaches to second end 264B of head 264. Neck 266 is cylindrical. Body 268 attaches to neck 266 opposite of head 264. Body 268 is also cylindrical and longer than neck 266 or head 264. Bumper 252 is made from rubber, TPE, or similar materials.

Different portions of bumper 252 have different diameters. Head 264 has a first diameter at first side 264A and a second diameter at second side 264B. The first diameter can be, for example, between 0.090 inches and 0.110 inches. The first diameter is preferably 0.100 inches. The second diameter can be between 0.190 inches and 0.210 inches. The second diameter is preferably 0.200 inches. Neck 266 has a third diameter. The third diameter can be between 0.090 inches and 0.110 inches. The third diameter is preferably 0.100 inches. Body 268 has a fourth diameter. The fourth diameter can be between 0.140 inches and 0.160 inches. The fourth diameter is preferably 0.150 inches. For example, bumper 252 can have the following dimensions: a first diameter of 0.100 inches at first side 264A of head 264, a second diameter of 0.200 inches at second side 264B of head 264, a third diameter of 0.100 inches at neck 266, and a fourth diameter of 0.150 inches at body 268.

Bumper 252 has a dimension NN from first end to second end. Dimension NN can be between 1.265 inches and 1.285 inches. Dimension NN is preferably 1.275 inches. Body 268 of bumper 252 has a length of dimension PP. Dimension PP can be between 0.990 inches and 1.010 inches. Dimension PP is preferably 1.000 inches. Dimension PP can vary depending on which pocket 228 or 232 (shown in FIGS. 16A-16B) bumper 252 is being placed in. Dimension PP should be long enough to hold items (for example, aerosol cans and spray bottles) securely in pockets 228 and 232 and prevent the items from tipping over. Dimension PP is should also be sized so that bumpers 252 can move around and bend without being pulled out of bumper mounting slots 254. Neck 266 has a length of dimension QQ. Dimension QQ can be between 0.090 inches and 0.110 inches. Dimension QQ is preferably 0.100 inches. Dimension QQ is sized to fit the thickness of interior compartment 214 between head 264 and body 268.

Bumper 252 is designed so head 264 can fit through bumper mounting slots 254 (shown in FIGS. 14A-14B and 17). Head 264 is tapered to make it easier to fit bumper 252 into bumper mounting slots 254. Neck 266 sits in bumper mounting slots 254 when installed into caddy 210 (shown in FIGS. 13A-13B). The third diameter of neck 266 is smaller than the second diameter of second side 264B of head 264 and the fourth diameter of body 268 so bumpers 252 are held firmly in bumper mounting slots 254. Bodies 268 of bumpers 252 grip items and hold items stored in corner pockets 228 and end pockets 232. Bumpers 252 can be included in any embodiments of caddy 210 described in relation to this disclosure, including caddy 10 (shown in FIGS. 1-6) and caddy 110 (shown in FIGS. 7-12). Inclusion of bumpers 252 in other embodiments of caddy 210 will also include bumper mounting slots 252 being included in inner compartment 14 of caddy 10 and inner compartment 114 of caddy 110.

Figure 21A:
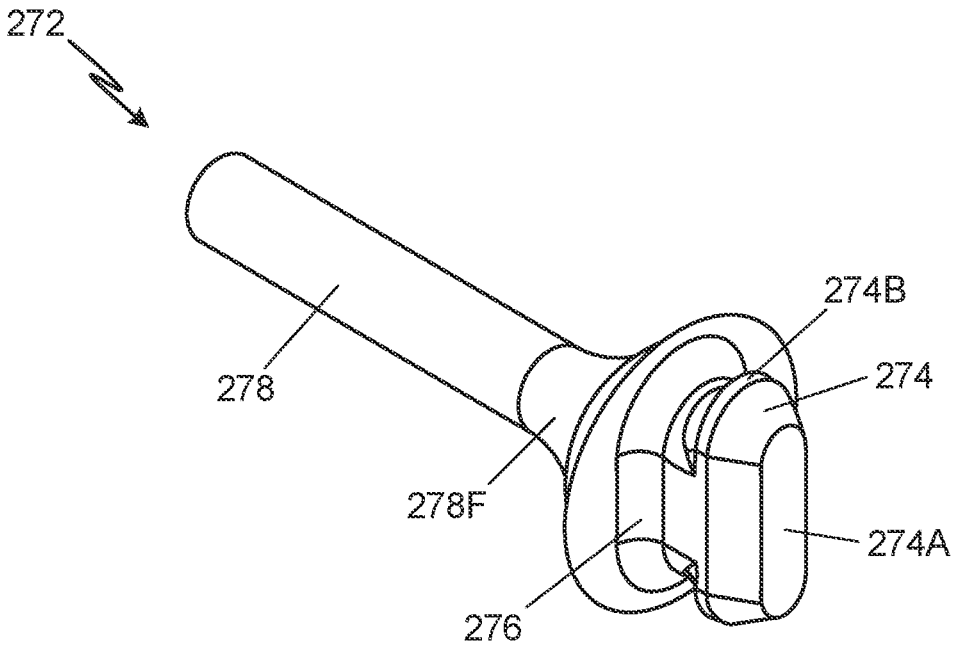
FIG. 21A is an isometric view of a second embodiment of a bumper designed to be positioned in the bumper mounting slots of the caddy shown in FIGS. 13A-13B.
Figure 21B:
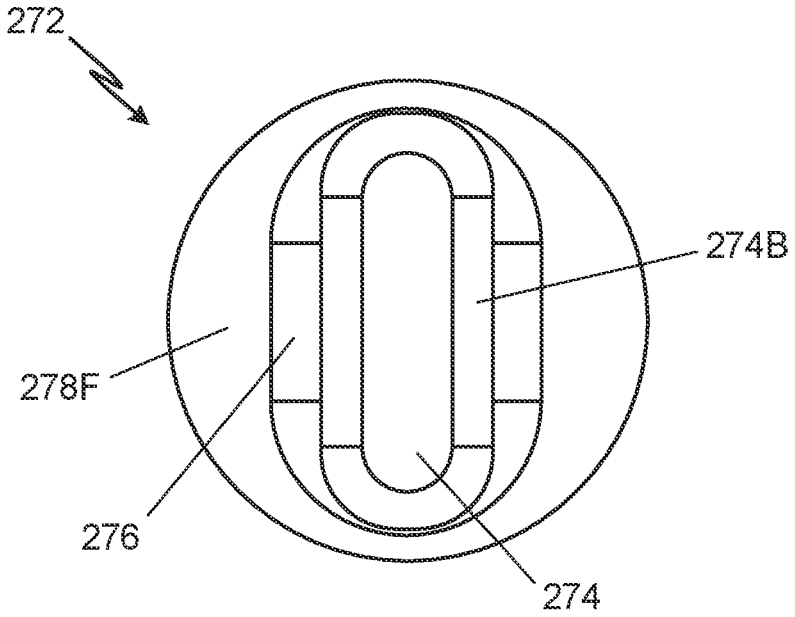
FIG. 21B is a back view of the bumper of FIG. 21A.
Figure 21C:
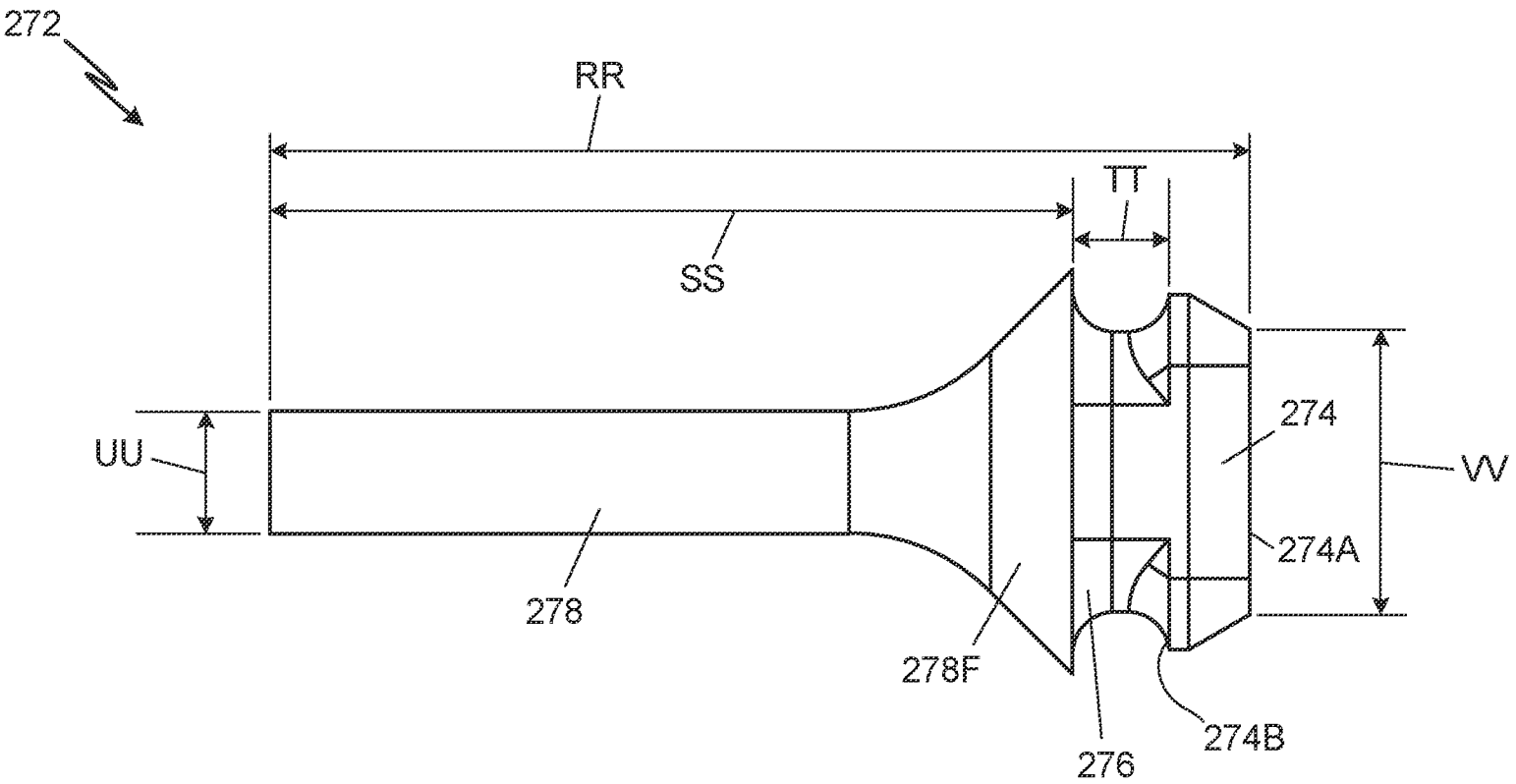
FIG. 21C is a side view of the bumper of FIG. 21A.

FIG. 21A is an isometric view of bumper 272 designed to be positioned bumper mounting slots 254 of caddy 210 (shown in FIGS. 13A-13B). FIG. 21B is a back view of bumper 272. FIG. 21C is a side view of bumper 272. FIGS. 21A-21C will be discussed together. Bumper 272 includes head 274 with chamfered edge 274C, neck 276, and body 278 with flared base 278F. FIG. 21C also includes dimensions RR-VV. Bumper 272 can be used with caddy system 208 (shown in FIGS. 13A-13B) and caddy 210 (shown in FIGS. 14A-20) and are interchangeable with bumpers 252.

Bumper 272 has head 274, neck 276, and body 278 aligned linearly from a first end of bumper 727 (on a right of FIG. 21A and FIG. 21C) to a second end (on a left of FIG. 21A and FIG. 21C). Head 274 has an oval shape with two curves opposite one another and connected by two straightaways. Head 274 includes a first side 274A and a second side 274B. First side 274A has a smaller surface area than second side 274B. Head 274 is chamfered between first side 274A and second side 274B. Neck 276 also has an oval shape with two curves opposite one another and connected by two straightaways. The straightaways of neck 276 connect to the straightaways of second side 274B of head 274. The curves of neck 276 are filleted where they attach to second side 274B of head 274. The curves of neck 276 are also filleted where they attach to flared base 278F of body 278. Body 278 of bumper 272 has a flared based 278F where body 278 attaches to neck 276. The flared base 278F tapers from a larger diameter to a smaller diameter of body 278. Flared base 278F can be between one-quarter and one-third of a length of body 278. Bumper 272 is made from rubber, TPE, or similar materials.

Dimensions RR-VV are shown in FIG. 21C. Dimension RR is a length of bumper 272. Dimension RR can be, for example, between 1.210 inches and 1.230 inches. Dimension RR is preferably 1.220 inches. Dimension SS is a length of body 278 including flared base 278F. Dimension SS can be between 0.94 inches and 1.06 inches. Dimension SS is preferably 1.00 inches. Dimension SS can vary depending on which pocket 228 or 232 (shown in FIGS. 16A-16B) bumper 272 is being placed in. Dimension SS should be long enough to hold items (for example, aerosol cans and spray bottles) securely in pockets 228 and 232 and prevent the items from tipping over. Dimension TT is a length of neck 276 from flared base 278F to second side of head 274B. Dimension TT can be between 0.110 inches and 0.130 inches. Dimension TT is preferably 0.120 inches. Dimension UU is a diameter of body 278. Dimension UU can be between 0.140 inches and 0.160 inches. Dimension UU is preferably 0.150 inches. Dimension VV is a width of head 274 along the widest part of the oval. Dimension VV is preferably between 0.335 inches and 0.355 inches. Dimension VV can be between 0.345 inches.

Bumper 272 is designed so head 274 fits through and neck 276 sits in bumper mounting slots 254. Body 278 extends into pockets of caddy 210 (for example, corner pockets 228 and end pockets 232, as shown in FIGS. 13A-13B). Head 274 has chamfered edge 274B to help fit through bumper mounting slots 254. The fillets of neck 276 allow head 274 to bend toward neck 276 as bumper 272 is positioned in bumper mounting slot 252. The oval shape of neck 276 contacts sides of rectangular bumper mounting slots 254 to limit spinning and vertical motion of bumper 272 as items are slid past body 278 into and out of pockets 228 and 232. Neck is sized to fit snugly into bumper mounting slots 254 and thick enough to accommodate a thickness of inner compartment 214 (shown in FIGS. 14A-14B). The flared base 278F is larger than bumper mounting slots 254 and keeps bumper body 278 from being pushed through into hollow space 250 (shown in FIGS. 16B-18). The flared base 278F of body 278 also provides stability to bumpers 272 when in use in caddy 210. Bumper 272 can be used with any embodiment of caddy 210 discussed in relation to this disclosure including caddy 10 (shown in FIGS. 1-6) and caddy 110 (shown in FIGS. 7-12). Inclusion of bumpers 252 in other embodiments of caddy 210 will also include bumper mounting slots 252 being included in inner compartment 14 of caddy 10 and inner compartment 114 of caddy 110.

Figure 22:
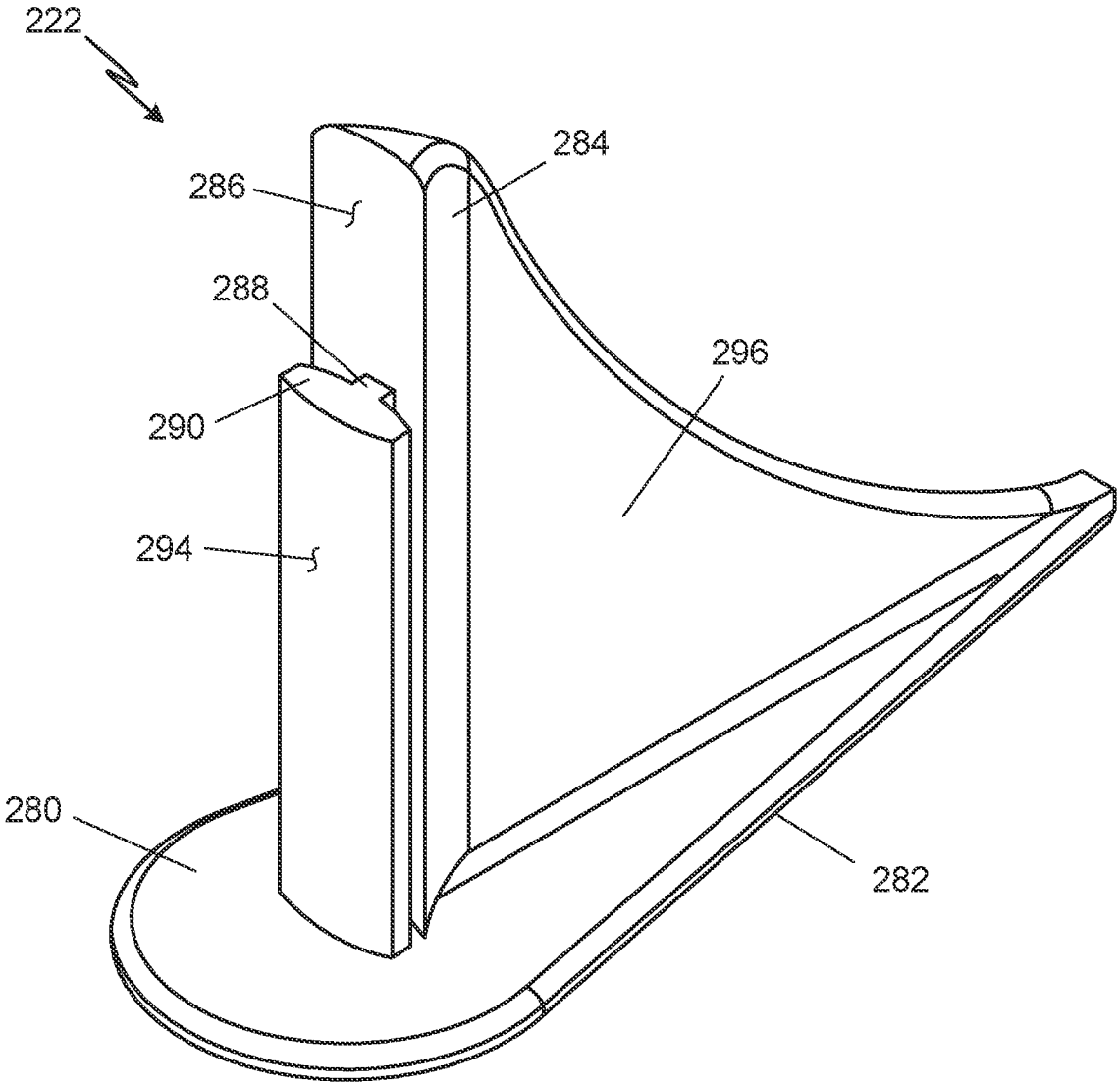
FIG. 22 is an isometric view of a first embodiment of a stabilizer designed to be positioned in the stabilizer mounting slots of the caddy shown in FIGS. 13A-13B.
Figure 23:
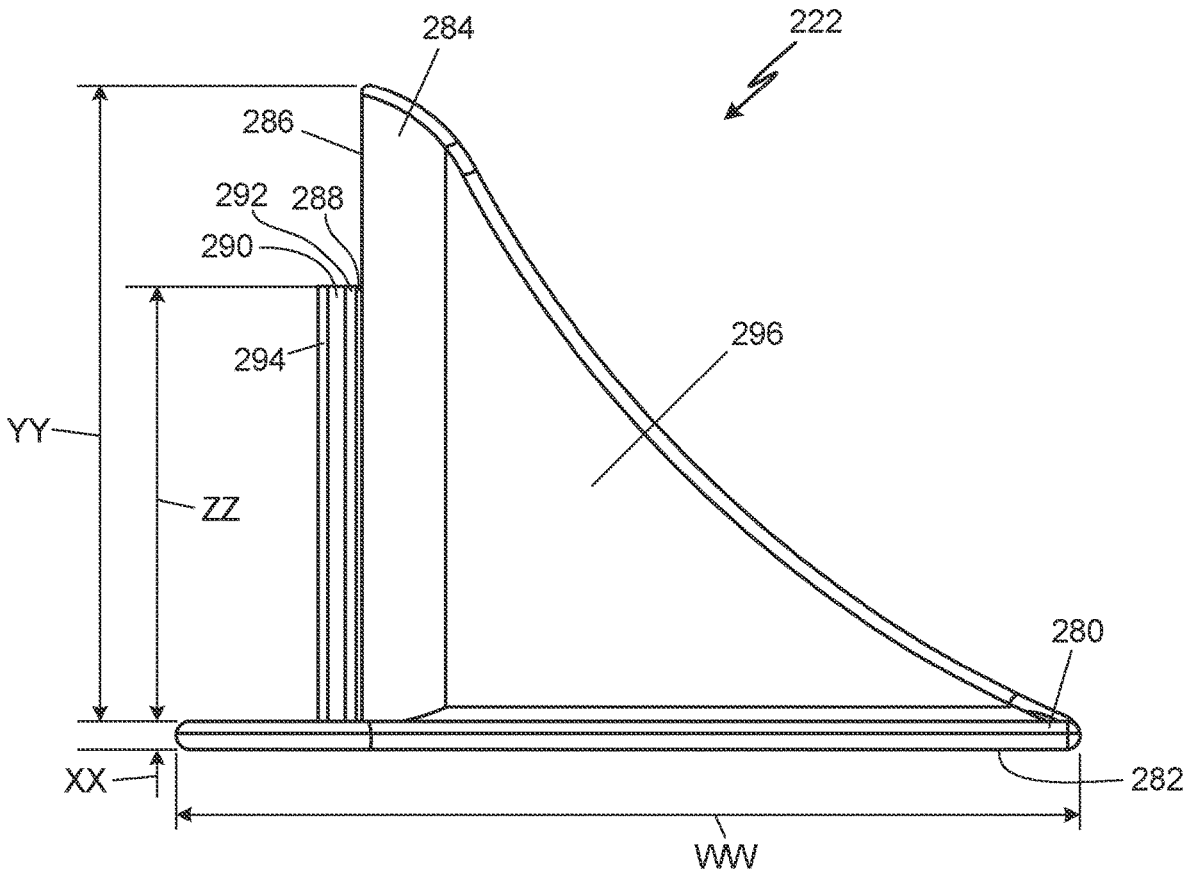
FIG. 23 is a side view of the stabilizer of FIG. 22.
Figure 24:
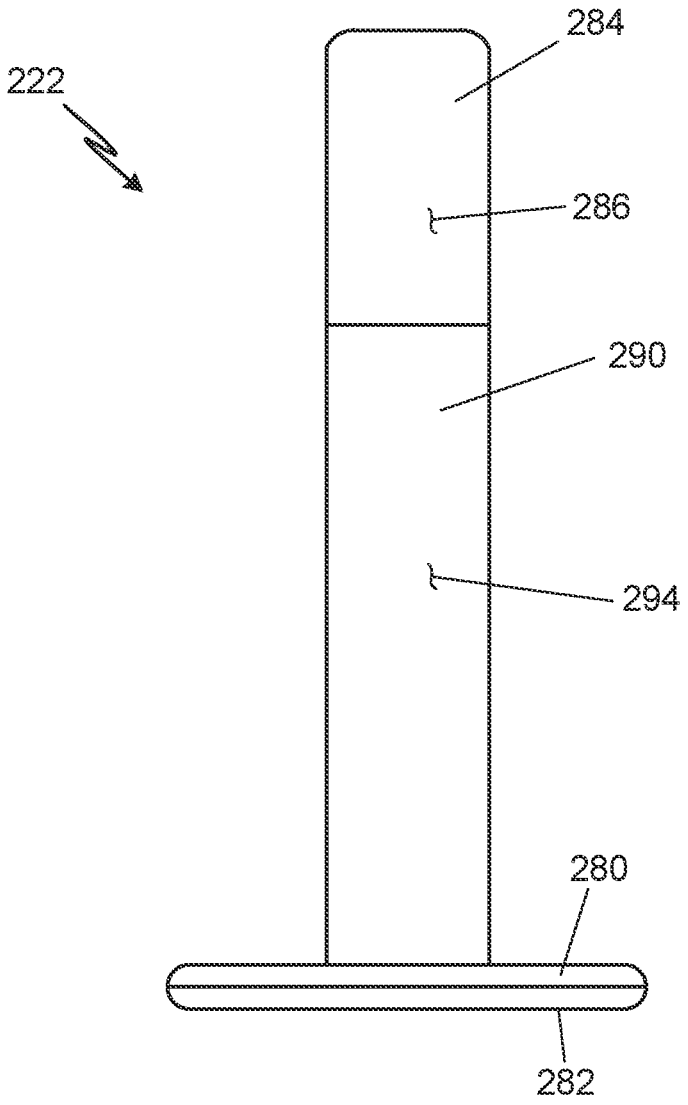
FIG. 24 is a front view of the stabilizer of FIG. 22.
Figure 25:
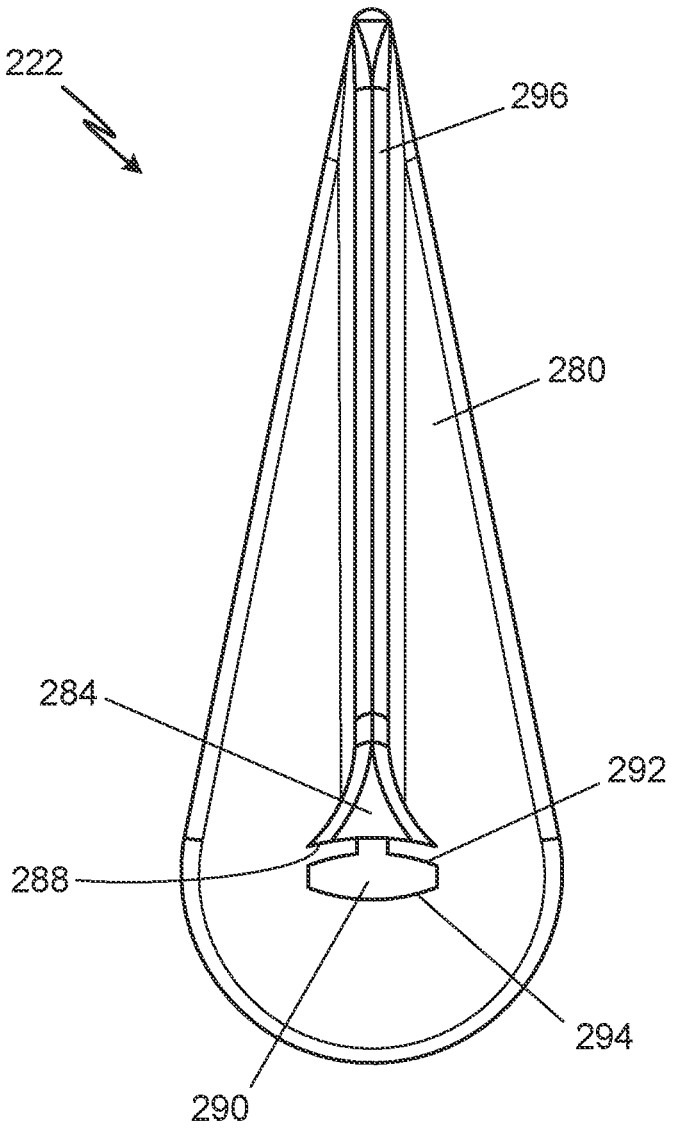
FIG. 25 is a top view of the stabilizer of FIG. 22

FIG. 22 is an isometric view of stabilizer 222. FIG. 23 is a side view of stabilizer 222. FIG. 24 is a front view of stabilizer 222. FIG. 25 is a top view of stabilizer 222. FIGS. 22-25 will be discussed together. Stabilizer 222 includes foot 280 with bottom surface 282 (shown in FIGS. 22-24), shoulder 284 with inner surface 286, neck 288 (shown in FIGS. 22-23 and 25), head 290 with inner surface 292 (shown in FIGS. 23 and 25) and outer surface 294, and web 296 (shown in FIGS. 22-23 and 25). FIG. 23 also dimensions WW-ZZ.

Foot 280 is a base of stabilizer 222. Foot 280 has a teardrop shape with an inner side being rounded and an outer side being pointed. Dimension WW is a length of foot 280 from a middle of the rounded side to a point of the pointed side (see FIG. 23). Dimension WW can be between 6.206 inches and 3.226 inches. Dimension WW is preferably 6.216 inches. Foot 280 has a width between 2.223 inches and 2.243 inches at its widest point. The width of foot 280 is preferably 2.233 inches. Foot 280 has bottom surface 282, which is one side of foot 280. Bottom surface 282 contacts the surface on which caddy system 208 sits when stabilizer 222 is assembled with caddy 210 (shown in FIGS. 13A-13B). Dimension XX is a thickness of foot 280 between bottom surface 282 and a top of foot 280. Dimension XX can be between 0.128 inches and 0.248 inches. Dimension XX is preferably 0.188 inches.

Shoulder 284 extends from the top of foot 280. Shoulder 284 extends generally perpendicularly to foot 280. However, shoulder 284 may extend from foot 280 at an angle slightly less than 90 degrees to better mate with caddy 210 (as shown in FIGS. 13A-13B). Shoulder 284 is positioned closer to the rounded inner side of foot 280. Inner surface 286 of shoulder 284 is faces the rounded inner side of foot 280. Inner side 284 is slightly concave to mate with an outer surface of outer shell 212 (shown in FIGS. 13A-16B). Shoulder 280 has a height of dimension YY. Dimension YY can be between 4.553 inches and 4.573 inches. Dimension YY is preferably 4.563 inches.

Neck 288 attaches to inner surface 286 of shoulder 284. Neck 288 is narrower and shorter than shoulder 284. Neck 288 has a height of Dimension ZZ. Dimension ZZ can be between 2.990 inches and 3.010 inches. Dimension ZZ is preferably 3.000 inches. Dimension ZZ can be anywhere between two-thirds and three-quarters a height of shoulder 284 to fit into stabilizer mounting slots 256 of caddy 210. Neck 288 has a width designed fit snugly into stabilizer mounting slots 256 so that stabilizer 222 does not fall out when caddy 210 is picked up. Neck 288 also has a depth between head 290 and shoulder 286 designed to fit the thickness of caddy 210. The depth of neck 288 can be between 0.90 inches and 0.110 inches. The depth of neck 288 is preferably 0.100 inches.

Head 290 includes outer surface 292 and inner surface 294. Outer surface 292 faces the pointed outer side of foot 280. Outer surface 292 of head 290 is convex shaped to mate with an inner surface of outer shell 212. Inner surface 294 faces the rounded inner side of foot 280. Inner surface 294 is slightly convex to provide support and stability. However, inner surface 294 can be flat or convex to save material. Head 290 attaches to neck 288 by outer surface 292. Head 290 and neck 288 are shown in FIGS. 22-25 as having a same height of dimension ZZ. However, head 290 and neck 288 may be different heights as needed. For example, head 290 could be taller than neck 288 to make stabilizer 222 fit into stabilizer mounting slot more securely.

Web 296 can be between shoulder 284 and foot 280. Web 296 attaches to a side of shoulder 284 opposite interior surface 286 and extends to a top of foot 280. Web 296 is generally triangular shaped with a curved top.

Stabilizer 222 slides into stabilizer mounting slots on caddy 210 to enlarge an effective base of caddy 210, as discussed in relation to FIGS. 13A-13B. Shoulder 284 creates an anchor for neck 288 and head 290. Inner surface 286 of shoulder 284 grips outer shell 212 of caddy 210. Neck 288 fits into stabilizer mounting slot. Head 290 keeps neck 288 from slipping out of stabilizer mounting slot. The convex shape of outer surface 292 of head 290 also grips outer shell 212 of caddy 210. Web 296 reinforces shoulder 284. Web 296 is narrow so that items may be placed around caddy 210 when stabilizers 222 are connected.

Stabilizer 222 is designed to increase the surface area covered by caddy 210 to reduce the chance of caddy 210 tipping over when bottles and other items are placed inside corner pockets 228 and side pockets 232 (shown in FIGS. 13A-16B). Stabilizer 222 is removable so that when caddy system 208 is being stored or otherwise not in use, it takes up less space and/or can be stored on its side. Inner surface 286 of shoulder 284 and inner surface 292 of head 290 are shaped to fit into corners 224 of caddy 210 and hold stabilizers 222 onto caddy 210.

Figure 26:
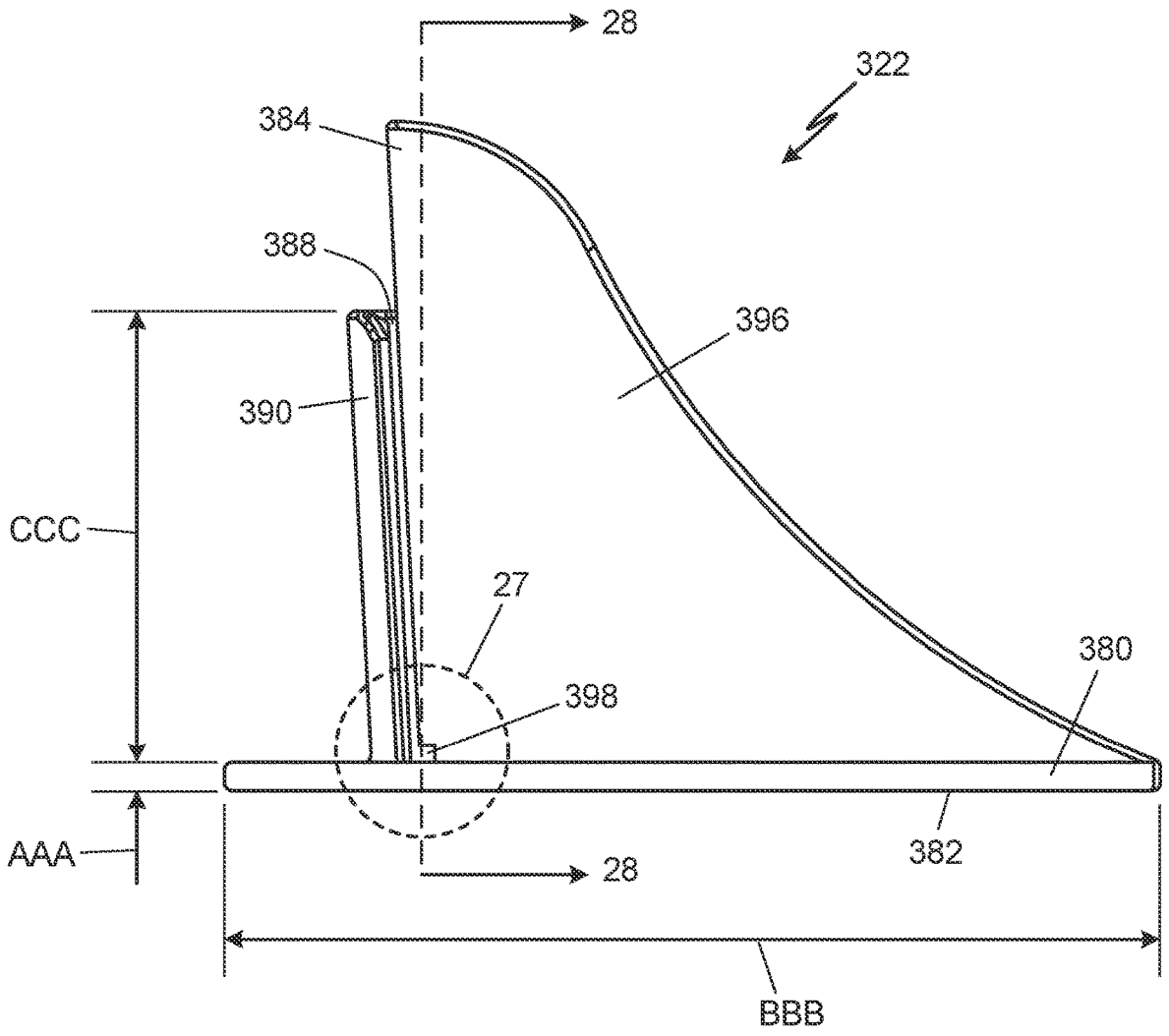
FIG. 26 is an side view of a second embodiment of a stabilizer designed to be positioned in the stabilizer mounting slots of the caddy shown in FIGS. 13A-13B.

FIG. 26 is a side view of stabilizer 322. Stabilizer 322 is a second embodiment of stabilizer 222. Stabilizer 322 can be used with caddy 210 as stabilizer 222 is. The reference numerals that refer to parts of stabilizer 322 are incremented by one-hundred compared to the reference numerals that refer to parts of stabilizer 222 shown in FIGS. 22-25. Stabilizer 322 includes foot 380 with bottom surface 382, shoulder 384, neck 388, head 390, web 396 (shown in FIG. 26), and slot 398. FIG. 26 also shows section 27 and line 28-28. Section 27 circles slot 398. Line 28-28 is through shoulder 384.

Stabilizer 322 has the same general structure and function of stabilizer 222. Foot 280 has bottom surface 282. Foot 280 has a teardrop shape with a rounded end and a pointed end. Dimension AAA is a height of foot 380 from bottom surface 382 to the top surface of foot 380. Dimension AAA can be between 0.178 inches and 0.198 inches. Dimension AAA is preferably 0.188 inches. Dimension BBB is a length of foot 380 from the rounded end to the pointed end. Dimension BBB can be between 6.206 inches and 6.226 inches. Dimension BBB is preferably 6.216 inches.

Shoulder 384, neck 388, and head 390 all extend from foot 380 at an angle less than 90 degrees to better mate with caddy 210. Neck 388 is attached between shoulder 384 and head 390. Neck is 388 is narrower than head 390 and shoulder 386 to fit into stabilizer mounting slot 256 of caddy 210. Neck 388 and head 390 are about three-quarters to two-thirds the height of shoulder 384. Dimension CCC is a height of head 390 and neck 388. Dimension CCC can be between 2.94 inches and 3.06 inches. Dimension CCC is preferably 3.00 inches. Web 296 is generally triangular and can be between shoulder 284 and foot 280.

Stabilizer 322 includes slot 398 located at a base of shoulder 384 and a top of foot 380. Slot 398 extends to head 390 and into shoulder 384. Slot 398 mates with rim 224L of caddy 210 (shown in FIG. 19). Slot 398 will be discussed in further detail in relation to FIG. 27.

Figure 27:
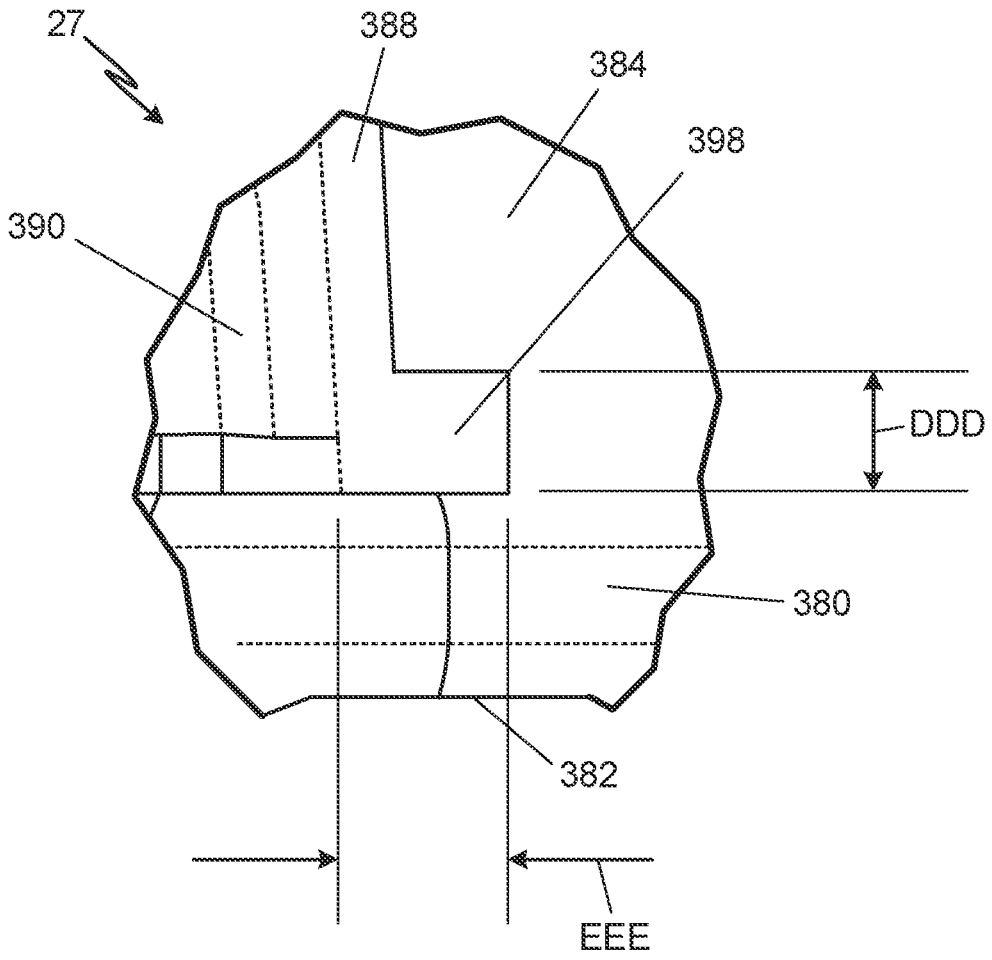
FIG. 27 is an enlarged view of section 27 shown in FIG. 26.

FIG. 27 is an enlarged view of section 27 shown in FIG. 26. FIG. 27 shows foot 380, bottom surface 382, shoulder 384, neck 388, head 390, and slot 398. FIG. 27 also shows dimension ZZ and dimension AAA. Slot 398 is a rectangular cutout of shoulder 384. Slot 398 has a bottom defined by a top surface of foot 380. A top of slot 398 is in shoulder 384. Slot 398 has a height from the top surface of foot 380 into shoulder 384 of dimension DDD. Dimension DDD can be between 0.100 inches and 0.120 inches. Dimension DDD is preferably 0.110 inches. A first side of slot 398 is defined by head 390 and a second side of slot 398 is in shoulder 384. Slot 388 has Dimension EEE, which is a width from head 390 into shoulder 384. Dimension EEE can be between 0.144 inches and 0.164 inches. Dimension EEE is preferably 0.154 inches. Slot 398 has a depth into shoulder 384 defined by a width of neck 388 (see FIG. 28).

Slot 398 is sized to fit lip 224L of bottom edge 224 of caddy 210 to help securely hold stabilizers 322 onto caddy 210. When stabilizers 322 are on caddy 210, lip 224L fits into slot 398 (see FIGS. 13A-13B and 15). Slot 398 is also small enough to allow stabilizer 322 to separate with a small amount of force so that stabilizer 322 can be removed from caddy 210 when necessary.

Figure 28:
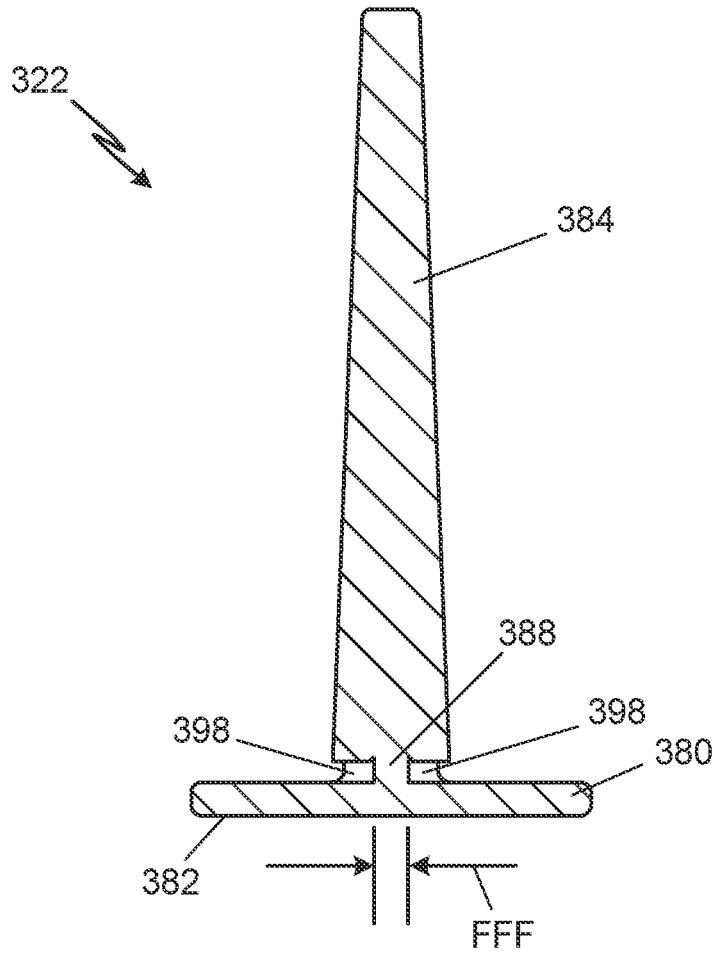
FIG. 28 is a cross-sectional view of the stabilizer of FIG. 26 taken along line 28-28.

FIG. 28 is a cross-sectional view of stabilizer 322 taken along line 28-28 of FIG. 26. FIG. 28 shows stabilizer 322, foot 380 with bottom surface 382, shoulder 384, neck 388 and slots 398. FIG. 28 also includes dimension FFF. Dimension FFF is a width of neck 388 left between slots 398. Dimension FFF can be between 0.178 inches and 0.198 inches. Dimension FFF is preferably 0.188 inches. Neck 388 is sized to fit into stabilizer mounting slot 256 when stabilizers 322 are on caddy 210. This allows lips 224L of bottom rim 224 to be held securely in slots 398 and not shift back and forth when stabilizer 322 is in position in caddy 210 (See FIGS. 13A-13B and 15).

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A caddy system comprising:
- a caddy comprising:
  - an outer shell comprising:
    - a plurality of walls that define a plurality of corners;
    - a bottom edge that includes bottom surfaces of the plurality of walls; and
    - a top rim;
  - an inner compartment surrounded by the outer shell and connected to the top rim, the inner compartment comprising:
    - a plurality of pockets, each pocket having an open top and a closed bottom; and
    - a plurality of bumper mounting slots positioned through sides of the plurality of pockets;
  - a handle connected to the inner compartment;
- a plurality of stabilizers, wherein one stabilizer is connected to each of the plurality of corners; and
- a plurality of bumpers that each connect to the caddy at the plurality of bumper mounting slots;
- wherein each of the bumpers comprises:
  - a head at a first side of the bumper;
  - a body at a second side of the bumper; and
  - a neck between the head and the body;
  - wherein the neck has a smaller diameter than the head and the body; and
  - wherein the bumper fits into the bumper mounting slot with the body extending into a pocket and the neck is inside the bumper mounting slot; and
- wherein an area having a periphery defined by outer ends of the connected stabilizers is larger than an area having a periphery defined by the bottom edge of the caddy.

2. The caddy system of claim 1, wherein the head and the neck of the bumper have an oval shape, wherein the head has a chamfered surface, and wherein the neck has fillets.

3. The caddy system of claim 1, wherein the body has a flared base located adjacent to where the neck and the body meet.

4. The caddy system of claim 1, wherein the plurality of stabilizers are removable from the caddy.

5. The caddy system of claim 1, wherein the caddy further comprises:
- a plurality of stabilizer mounting slots, wherein one stabilizer mounting slot is in each of the plurality of corners; and wherein each of the plurality of stabilizers fits into each of the plurality of stabilizer mounting slots.

6. The caddy system of claim 1, wherein each pocket has two bumper mounting slots; and wherein the bumper mounting slots are adjacent one another or the bumper mounting slots are across from one another.

* * * * *